US007794335B2

(12) United States Patent
Cole et al.

(10) Patent No.: US 7,794,335 B2
(45) Date of Patent: Sep. 14, 2010

(54) CLUB HEADS WITH CONTOURED BACK FACES AND METHODS OF MANUFACTURING THE SAME

(75) Inventors: Eric V. Cole, Phoenix, AZ (US); Randall B. Noble, Phoenix, AZ (US); David L. Petersen, Peoria, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 7 days.

(21) Appl. No.: 12/250,395

(22) Filed: Oct. 13, 2008

(65) Prior Publication Data

US 2010/0093459 A1 Apr. 15, 2010

(51) Int. Cl.
*A63B 53/04* (2006.01)

(52) U.S. Cl. ..... 473/342; 473/346

(58) Field of Classification Search ..... 473/324–350
See application file for complete search history.

(56) References Cited

U.S. PATENT DOCUMENTS 4,635,941 A 1/1987 Yoneyama
4,802,672 A * 2/1989 Long ..... 473/291
4,854,581 A * 8/1989 Long ..... 473/290
4,858,929 A * 8/1989 Long ..... 473/290
4,957,294 A * 9/1990 Long ..... 473/350
5,090,702 A * 2/1992 Viste ..... 473/331
5,221,087 A * 6/1993 Fenton et al. ..... 473/342
5,282,624 A * 2/1994 Viste ..... 473/342
5,297,803 A * 3/1994 Solheim ..... 473/350
5,401,021 A * 3/1995 Allen ..... 473/291
5,531,439 A * 7/1996 Azzarella ..... 473/331
5,601,501 A * 2/1997 Kobayashi ..... 473/350
5,611,742 A 3/1997 Kobayashi
5,676,605 A * 10/1997 Kobayashi ..... 473/331
5,711,722 A * 1/1998 Miyajima et al. ..... 473/346
5,735,755 A * 4/1998 Kobayashi ..... 473/342
5,944,619 A * 8/1999 Cameron ..... 473/332
5,961,394 A * 10/1999 Minabe ..... 473/305
6,179,726 B1 * 1/2001 Satoh et al. ..... 473/290
6,203,449 B1 3/2001 Kenmi
6,224,497 B1 * 5/2001 Antonious ..... 473/330
6,257,994 B1 * 7/2001 Antonious ..... 473/331
6,299,548 B1 10/2001 Lin
6,322,459 B1 * 11/2001 Nishimura et al. ..... 473/330
6,334,818 B1 * 1/2002 Cameron et al. ..... 473/332
6,379,262 B1 * 4/2002 Boone ..... 473/324
D481,432 S 10/2003 Greene
6,652,391 B1 11/2003 Kubica et al.
6,702,689 B2 * 3/2004 Ashton ..... 473/251
D490,129 S 5/2004 Greene
6,824,475 B2 * 11/2004 Burnett et al. ..... 473/329
6,951,517 B2 * 10/2005 Lindsay ..... 473/313
6,979,270 B1 * 12/2005 Allen ..... 473/290
7,018,303 B2 * 3/2006 Yamamoto ..... 473/329
7,066,833 B2 * 6/2006 Yamamoto ..... 473/330
7,166,039 B2 * 1/2007 Hettinger et al. ..... 473/331

(Continued)

FOREIGN PATENT DOCUMENTS

JP 10005378 A * 1/1998

(Continued)

*Primary Examiner*—Alvin A Hunter

(57) ABSTRACT

Embodiments of club heads with contoured back faces and methods of manufacturing the same are described herein. Other embodiments and related methods are also disclosed herein

25 Claims, 15 Drawing Sheets

U.S. PATENT DOCUMENTS

| | | | | |
|---|---|---|---|---|
| 7,278,926 | B2 * | 10/2007 | Frame | 473/329 |
| 7,338,388 | B2 | 3/2008 | Schweigert et al. | |
| 7,347,794 | B2 | 3/2008 | Schweigert | |
| 7,452,283 | B2 * | 11/2008 | Hettinger et al. | 473/249 |
| 7,575,524 | B2 * | 8/2009 | Willett et al. | 473/342 |
| 7,585,232 | B2 * | 9/2009 | Krumme | 473/329 |
| 7,588,503 | B2 * | 9/2009 | Roach et al. | 473/332 |
| 2006/0183568 | A1 | 8/2006 | Bamber | |

FOREIGN PATENT DOCUMENTS

| | | | | |
|---|---|---|---|---|
| JP | 10024130 | A | * | 1/1998 |
| JP | 11333031 | A | * | 12/1999 |
| JP | 2000296191 | A | * | 10/2000 |
| JP | 2002253709 | A | * | 9/2002 |
| JP | 2005131280 | A | * | 5/2005 |
| WO | WO 2004022172 | A1 | * | 3/2004 |

* cited by examiner

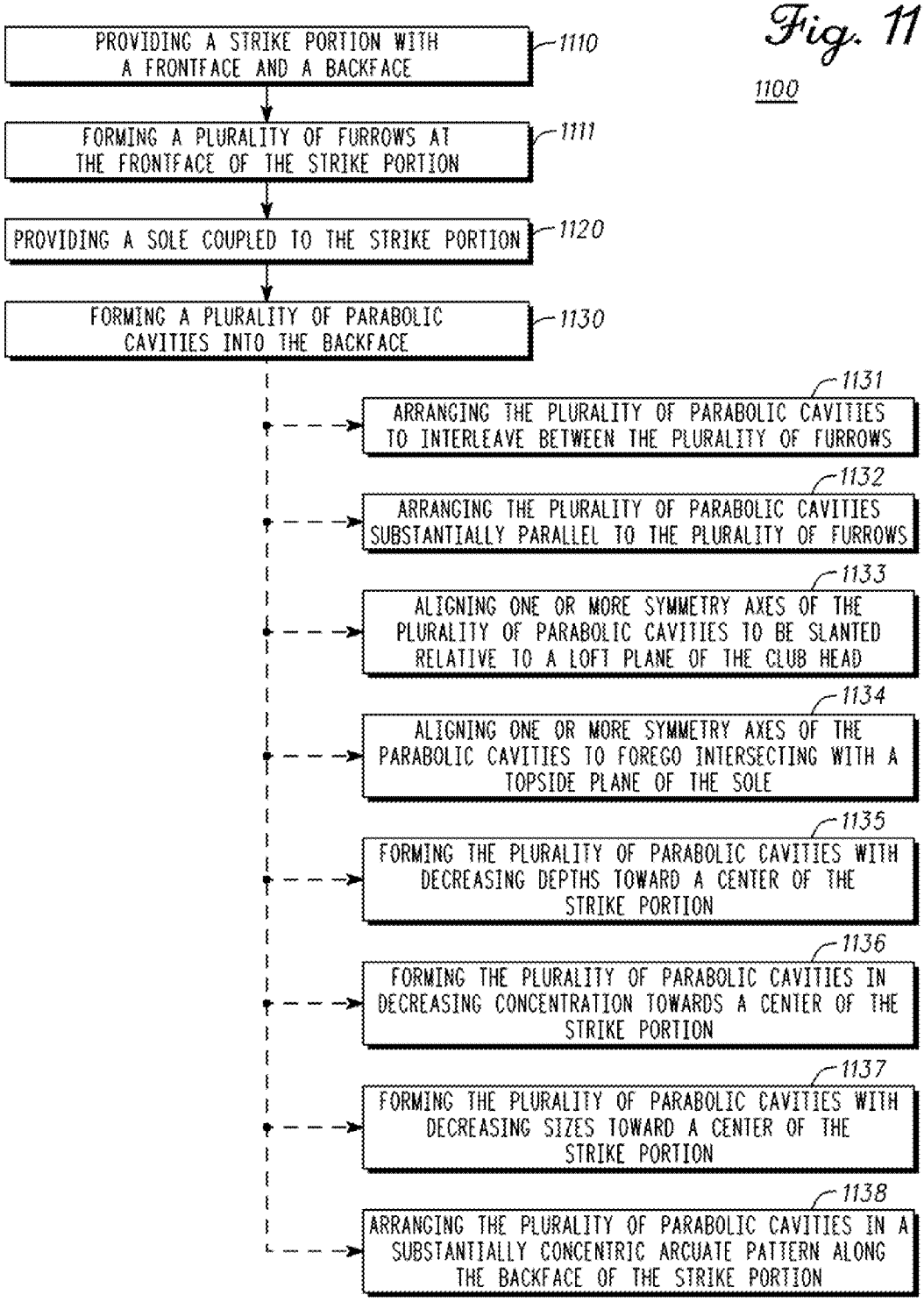
Fig. 11
1100
PROVIDING A STRIKE PORTION WITH A FRONTFACE AND A BACKFACE
1110
FORMING A PLURALITY OF FURROWS AT THE FRONTFACE OF THE STRIKE PORTION
1111
PROVIDING A SOLE COUPLED TO THE STRIKE PORTION
1120
FORMING A PLURALITY OF PARABOLIC CAVITIES INTO THE BACKFACE
1130
ARRANGING THE PLURALITY OF PARABOLIC CAVITIES TO INTERLEAVE BETWEEN THE PLURALITY OF FURROWS
1131
ARRANGING THE PLURALITY OF PARABOLIC CAVITIES SUBSTANTIALLY PARALLEL TO THE PLURALITY OF FURROWS
1132
ALIGNING ONE OR MORE SYMMETRY AXES OF THE PLURALITY OF PARABOLIC CAVITIES TO BE SLANTED RELATIVE TO A LOFT PLANE OF THE CLUB HEAD
1133
ALIGNING ONE OR MORE SYMMETRY AXES OF THE PARABOLIC CAVITIES TO FOREGO INTERSECTING WITH A TOPSIDE PLANE OF THE SOLE
1134
FORMING THE PLURALITY OF PARABOLIC CAVITIES WITH DECREASING DEPTHS TOWARD A CENTER OF THE STRIKE PORTION
1135
FORMING THE PLURALITY OF PARABOLIC CAVITIES IN DECREASING CONCENTRATION TOWARDS A CENTER OF THE STRIKE PORTION
1136
FORMING THE PLURALITY OF PARABOLIC CAVITIES WITH DECREASING SIZES TOWARD A CENTER OF THE STRIKE PORTION
1137
ARRANGING THE PLURALITY OF PARABOLIC CAVITIES IN A SUBSTANTIALLY CONCENTRIC ARCUATE PATTERN ALONG THE BACKFACE OF THE STRIKE PORTION
1138

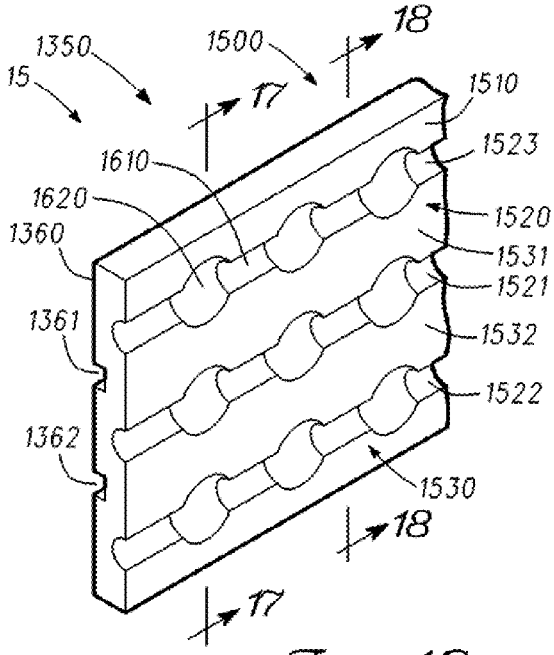
Fig. 16
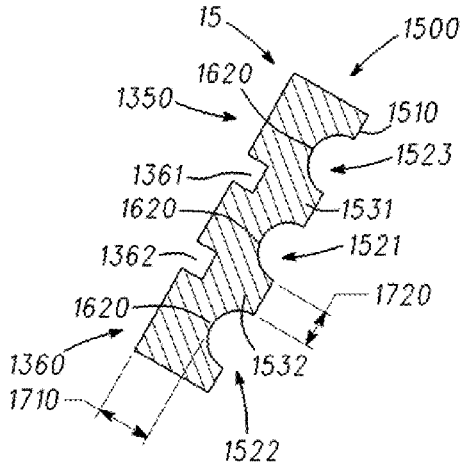
Fig. 17
Fig. 18
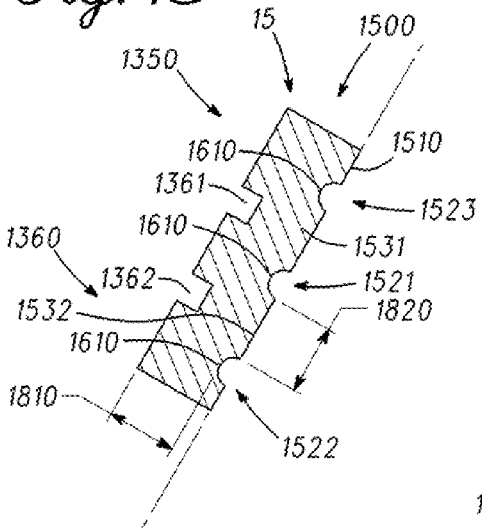
Fig. 19
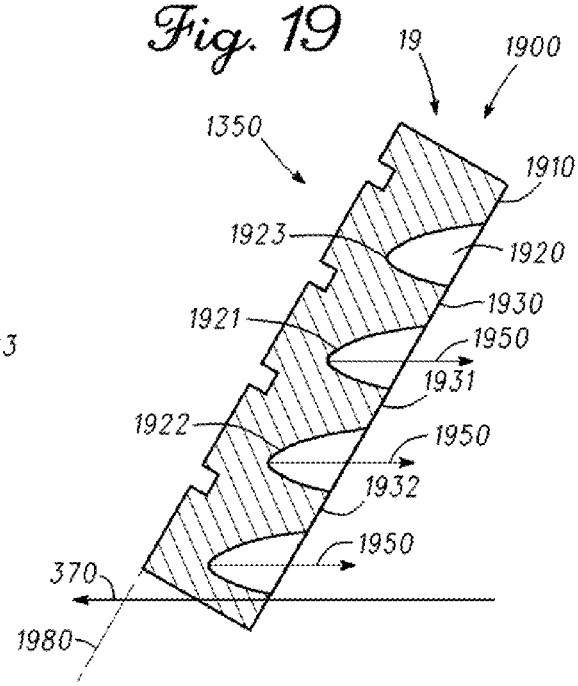

Fig. 24
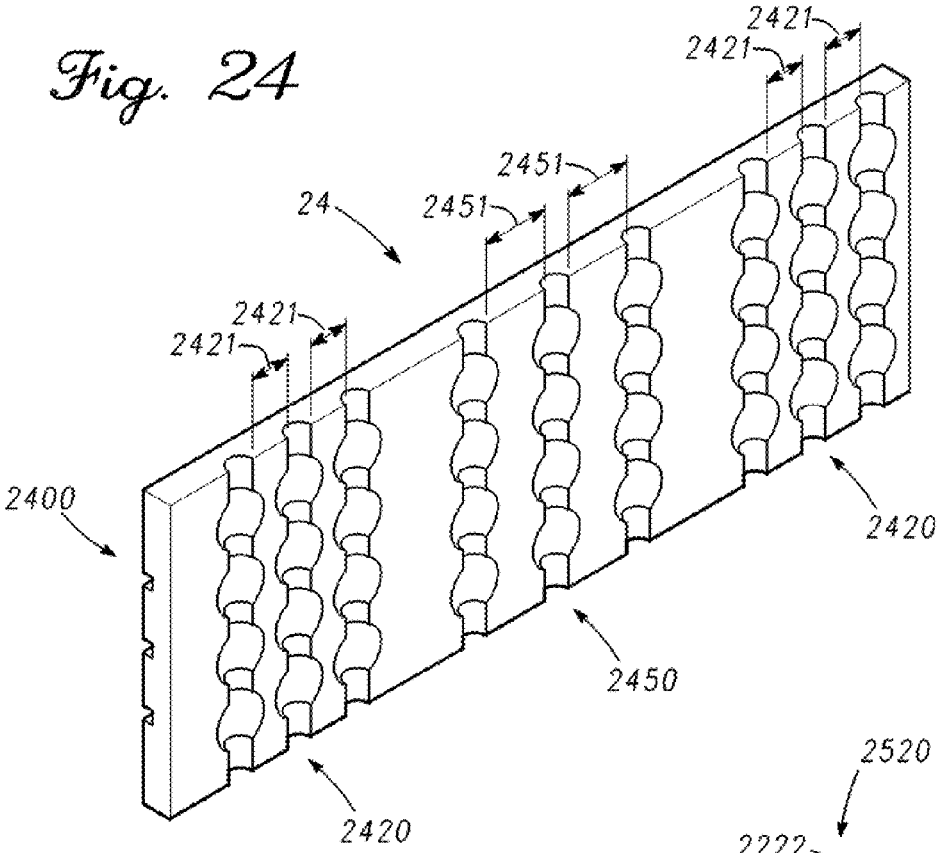
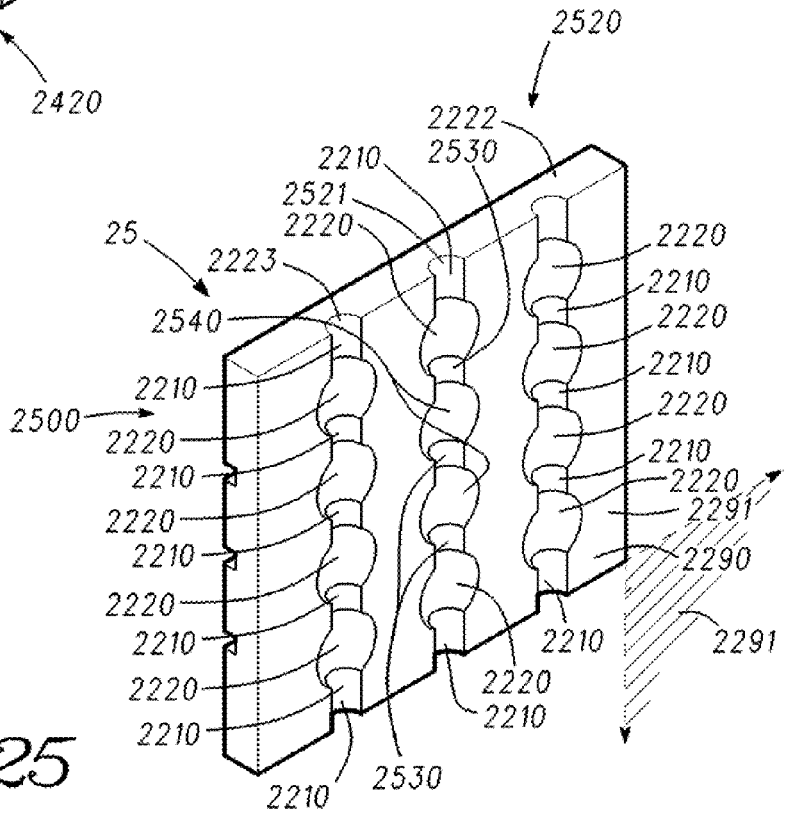
Fig. 25

2700

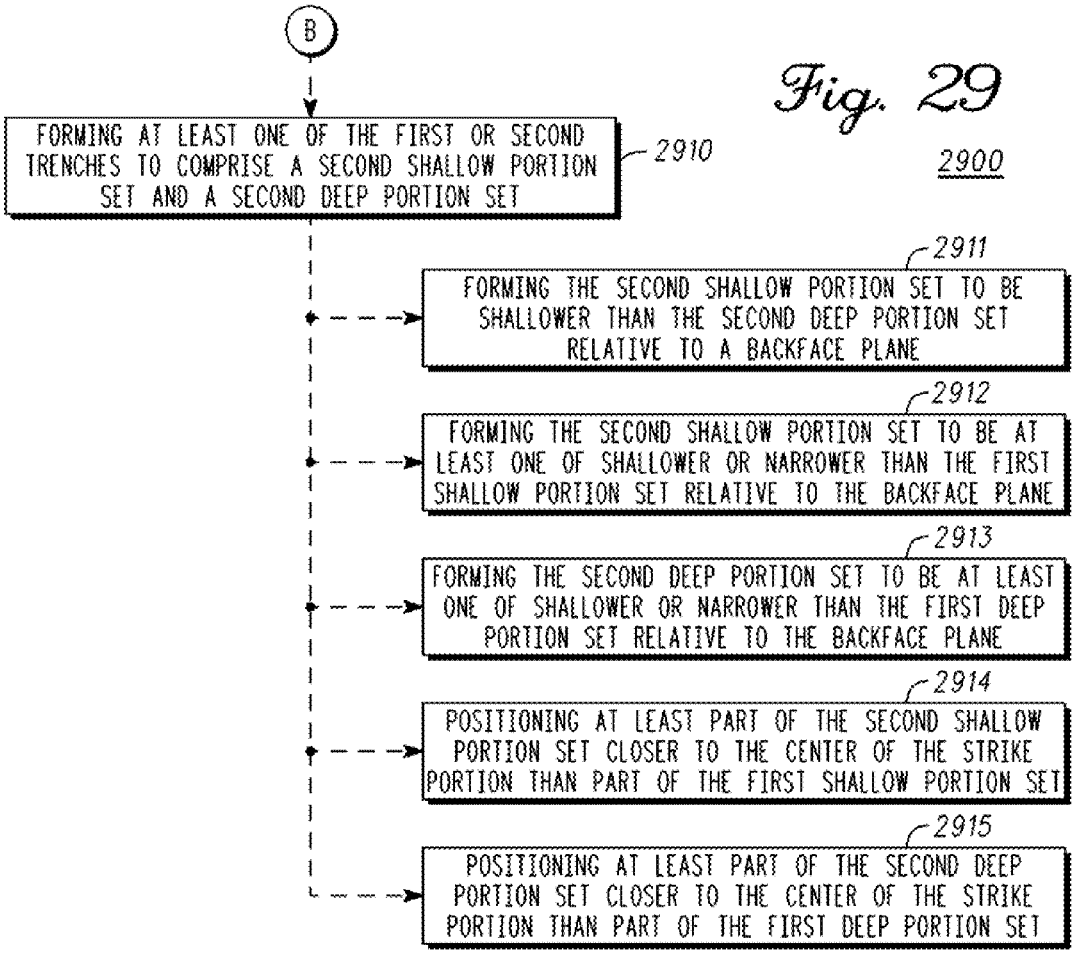
Fig. 29
Fig. 30
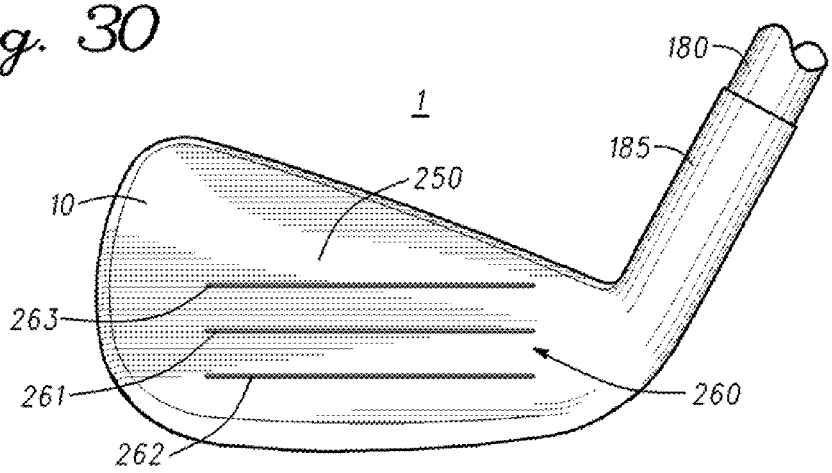

CLUB HEADS WITH CONTOURED BACK FACES AND METHODS OF MANUFACTURING THE SAME

TECHNICAL FIELD

This disclosure relates generally to sports equipment, and relates more particularly to club heads with contoured back faces and methods of manufacturing the same.

BACKGROUND

Several types of sports, such as baseball, cricket, and golf, require impacting objects with clubs. The design of such clubs typically requires balancing several factors, such as club weight and strength. For example, a strike portion of a golf club may be made thicker to better withstand stresses or forces induced upon impact with a golf ball. Increasing the thickness of the strike portion, however, tends to add unwanted weight, which can affect an individual's ability to swing the golf club at a desired speed. Conversely, making the strike portion thinner may permit the individual to better control the swing speed of the golf club, but may jeopardize the integrity of the strike portion to properly absorb, distribute, and/or dissipate impact forces.

BRIEF DESCRIPTION OF THE DRAWINGS

FIG. 11 illustrates a flowchart of a method for manufacturing a club head in accordance with one or more of FIGS. 1-10 in accordance with an embodiment of manufacturing a club head.

FIG. 16 illustrates a perspective cross-sectional view of part of the strike portion of FIG. 15.

FIG. 17 illustrates a cross-sectional side view of the strike portion of FIG. 16 along a cross-sectional line 17-17.

FIG. 18 illustrates a cross-sectional side view of the strike portion of FIG. 16 along a different cross-sectional line 18-18.

FIG. 19 illustrates a cross-sectional side view of part of a strike portion of a club head, where the strike portion comprises a slanted trench-set, in accordance with another embodiment.

FIG. 24 illustrates a perspective view of part of a strike portion of a club head, where the strike portion comprises at least two trench-sets that can differ from each other based the separation of their respective trenches, in accordance with another embodiment.

FIG. 25 illustrates a perspective view of part of a strike portion of a club head, where the strike portion comprises a trench-set having at least one trench that comprises two shallow portion sets and two deep portion sets of differing depths, in accordance with another embodiment.

FIG. 29 illustrates a flowchart of a method for forming a trench of the trench-set of the method of FIG. 28.

FIG. 30 illustrates a front view of the club and the club head of FIG. 1.

Figure 1:
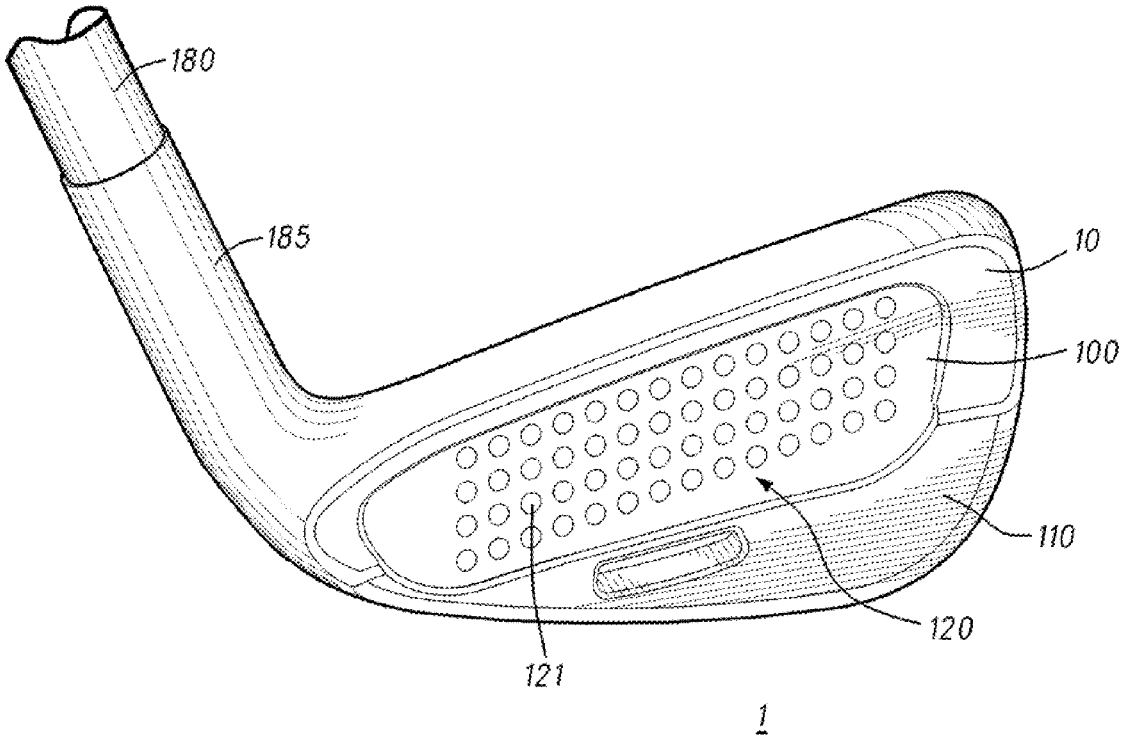
FIG. 1 illustrates a rear perspective view of a club with a club head that comprises a strike portion with a cavity set, in accordance with one embodiment of a club head.

For simplicity and clarity of illustration, the drawing figures illustrate the general manner of construction, and descriptions and details of well-known features and techniques may be omitted to avoid unnecessarily obscuring of the drawings. Additionally, elements in the drawing figures are not necessarily drawn to scale. For example, the dimensions of some of the elements in the figures may be exaggerated relative to other elements to help improve understanding of different embodiments. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the golf club attachment mechanism and related methods described herein are, for example, capable of operation in sequences other than those illustrated or otherwise described herein. Furthermore, the terms "include," and "have," and any variations thereof, are intended to cover a non-exclusive inclusion, such that a process, method, system, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the golf club attachment mechanism and related methods described herein are, for example, capable of operation in other orientations than those illustrated or otherwise described herein. The term "coupled," as used herein, is defined as directly or indirectly connected in an electrical, physical, mechanical, or other manner. The term "on," as used herein, is defined as on, at, or otherwise adjacent to or next to or over.

The terms "couple," "coupled," "couples," "coupling," and the like should be broadly understood and refer to connecting two or more elements, mechanically and/or otherwise, either directly or indirectly through intervening elements. Coupling may be for any length of time, e.g., permanent or semi-permanent or only for an instant.

The absence of the word "removably," "removable," and the like near the word "coupled," and the like does not mean that the coupling, etc. in question is or is not removable.

DESCRIPTION

In at least one embodiment, a club head can comprise a strike portion with a back face, wherein the back face comprises a first cavity-set with one or more first-cavities formed into the back face, and at least a first cavity of the first cavity-set comprises a parabolic inner surface.

In a different embodiment, a club head can comprise a strike portion comprising a back face and a strike face opposite the back face. The back face can comprise a first trench-set. The first trench-set can comprise a first trench of one or more trenches, where at least the first trench of the one or more trenches comprises a first shallow portion set with one or more first shallow portions, a first deep portion set with one or more first deep portions. The first shallow portion set is shallower than the first deep portion set relative to a loft plane along the back face. Other examples, embodiments, and related methods are further described below.

Figure 2:
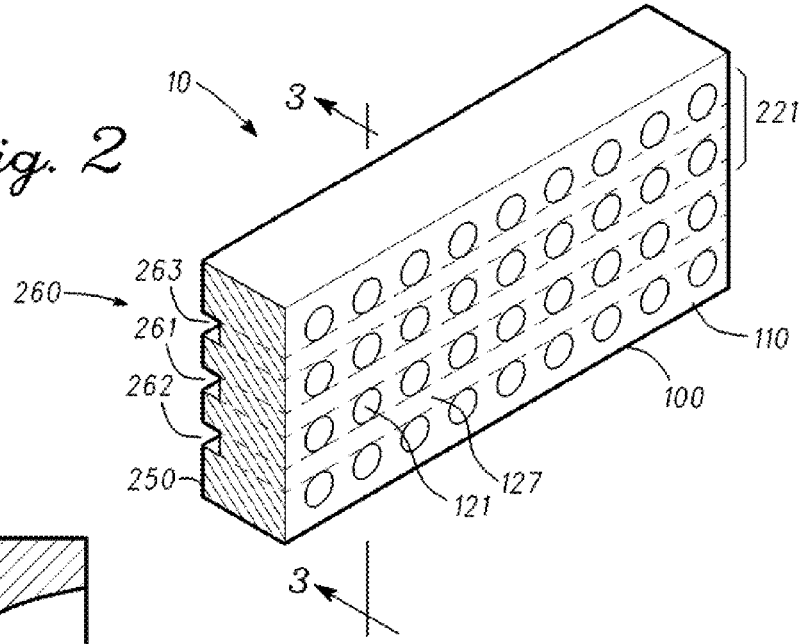
FIG. 2 illustrates a perspective cross-sectional view of part of the strike portion of FIG. 1.
Figure 3:
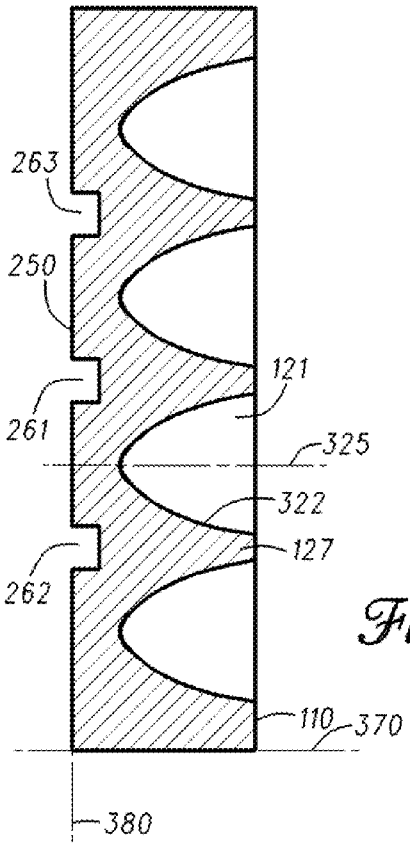
FIG. 3 illustrates a cross-sectional view of the strike portion of FIG. 2 along a cross-sectional line 3-3, where the strike portion comprises one or more cavities with parabolic inner surfaces.

Referring now to the figures, FIG. 1 illustrates a rear perspective view of club 1 with club head 10 having strike portion 100. Jumping ahead, FIG. 30 illustrates a front view of club 1 with club head 10 having strike portion 100. Returning to the beginning, FIG. 2 illustrates a perspective cross-sectional view of strike portion 100 of club head 10. FIG. 3 illustrates a cross-sectional view of strike portion 100 along cross-sectional line 3-3 of FIG. 2. Parts of club 1 may be omitted from FIGS. 1-3 and 30 for clarity.

Club 1 is illustrated in FIG. 1 as a golf club, and comprises club head 10 and shaft 180, where shaft 180 is coupled to club head 10 via hosel 185. In a different embodiment, shaft 1 can couple to club head 10 directly without the need of hosel 185, such as through a bore (not shown) in club head 10. Although club head 10 is illustrated herein as an iron head, where strike portion 100 is integral with club head 10, it will be understood that other embodiments of the present invention can comprise a different type of golf club head, such as a putter head, a driver head, a hybrid head, and a fairway wood head, among others. The teachings in this disclosure are not limited to any specific type of club or club head. For example, in other embodiments, strike portion 100 may comprise a strike plate that can be separately manufactured and then attached to a club head to form a strike face. In some examples, the strike face can be referred to as a front face.

Strike portion 100 of club head 10 comprises back face 110. Cavity-set 120 is formed into back face 110, where cavity-set 120 comprises cavities, such as cavity 121, formed into strike portion 100 at back face 110. In the present embodiment, strike portion 100 also comprises front face 250 opposite back face 110, where front face 250 comprises groove-set 260 with one or more grooves, such as grooves 261, 262, and 263. In some embodiments, the one or more grooves can be referred to as furrows. In one embodiment, groove-set 260 can be configured to impact a golf ball when an individual swings club 1 at the golf ball Back face 110 is exposed at the backside of iron club head 10. In other embodiments, however, back face 110 may not be exposed and/or could be encompassed by the club head to which it is attached, such as for example in the case of a wood golf club head. The teachings disclosed herein can be applicable regardless of whether back face 110 is exposed or visible at an exterior of a particular club head. Furthermore, club head 10 can have greater or fewer grooves in groove-set 260 and/or greater of fewer cavities of cavity-set 120 than illustrated in FIGS. 1-3 and 30.

In the present embodiment, each of the cavities of cavity-set 120 comprises a parabolic inner surface. For example, as seen in FIG. 3, cavity 121 comprises parabolic inner surface 322 formed into back face 110. There can be other embodiments where only some of the cavities of cavity-set 120 comprise parabolic inner surfaces. In some embodiments, parabolic inner surfaces can be referred to as parabolic shapes.

The employment of parabolic inner surfaces can be advantageous for several reasons. For example, during manufacturing processes such as casting, the parabolic inner surface 322 can facilitate removal of a cast-mold used to form cavity 121 because the surface of the cast-mold would not need to slide all the way out of cavity 121 to disengage from parabolic inner surface 322. The same concept applies in the case of hot-forging, where a hammer-die can be more easily disengaged from parabolic inner surface 322 for the same reasons. This technique contrasts with cavities comprising straight sidewalls and/or acute corners, where heightened friction forces could impede removal of the cast-mold or the hammer die from the cavity while disengaging from the acute corners and/or while sliding across the straight sidewalls.

In addition, cavities with straight sidewalls and/or acute corners can tend to localize and/or direct stress forces through the club head in a non-uniform manner. For example, upon impact of club head 10 with an object such as a golf ball, stress forces may be induced upon strike portion 100. If strike portion 100 comprised only cavities with straight sidewalls and/or acute corners, the stress forces may tend to accumulate and/or localize proximate to the acute corners of the cavities, and may tend to be directed in concentrated directions such as normal to the straight sidewalls. In contrast, parabolic inner surface 322 of cavity 121 provides no acute corners at which stress forces can localize, and its arcuate walls can disperse and/or distribute such forces more evenly across strike portion 100.

The use of parabolic inner surfaces is also advantageous when compared to spherical inner surfaces. For example, parabolic inner surfaces allow the formation of deeper cavities of smaller diameters than a spherical cavity would allow, permitting a higher concentration or density of deeper cavities. In contrast, a spherical cavity would be limited to a depth of its radius, such that a deeper spherical cavity would require a larger diameter to avoid straight sidewalls. Making a spherical cavity any deeper than its radius would introduce straight sidewalls with the disadvantages mentioned above. Cavities with parabolic inner surfaces therefore allow deeper cavities without acute corners or straight walls that can better disperse stress forces through the club head.

Other embodiments are envisioned, however, where not all of the cavities of cavity-set 120 comprise parabolic inner surfaces. For example, some of the cavities could comprise inner surfaces with spherical, cubical, cylindrical, triangular, or hexagonal surfaces, among other possible geometric options. Some of such embodiments may comprise cavities with parabolic inner surfaces positioned in areas expected to sustain greater stresses.

Although the embodiment of FIGS. 1-3 shows cavity 121 as comprising a diameter that continuously varies from back face 110 towards front face 250, other embodiments may comprise cavities that vary otherwise.

Figure 4:
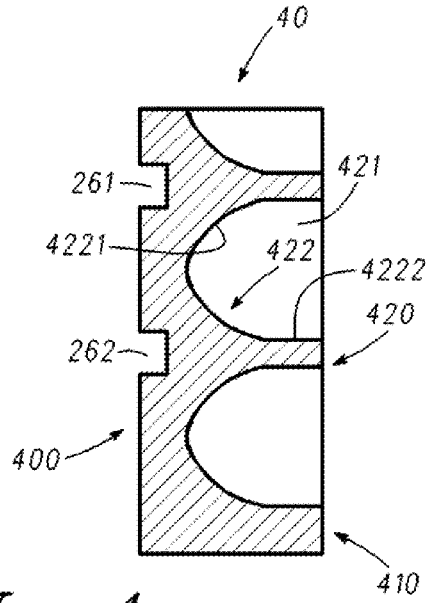
FIG. 4 illustrates a cross-sectional view of part of a strike portion that comprises one or more cavities with parabolic inner surfaces having parabolic and non-parabolic sections, in accordance with a different embodiment of a club head

FIG. 4 illustrates a cross-sectional view of part of a strike portion of a second club head, where the second strike portion comprises one or more cavities with parabolic inner surfaces having parabolic and non-parabolic sections. For example, FIG. 4 illustrates a perspective cross-sectional view of part of strike portion 400 of club head 40, where strike portion 400 comprises one or more cavities with parabolic inner surfaces having parabolic and non-parabolic sections. Strike portion 400 comprises back face 400 having cavity-set 420 with cavity 421, similar to cavity 121 (FIGS. 1-3), but differing in that parabolic inner surface 422 comprises parabolic section 4221 and non-parabolic section 4222. In the present example, non-parabolic section 4222 comprises a cylindrical path with parallel walls, leading to parabolic section 4221, where section 4221 comprises non-parallel parabolic walls. Such an arrangement can be useful for maximizing the depth and volume of cavity 421 while maintaining the benefits of stress dispersion afforded by the parabolic shape of parabolic section 4221. Although non-parabolic section 4221 is shown as comprising a cylindrical path, other embodiments may comprise a non-parabolic section with non-parallel walls.

Figure 5:
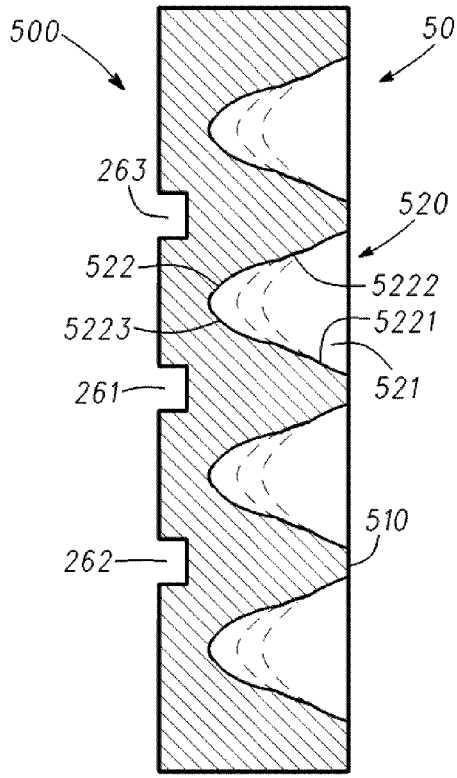
FIG. 5 illustrates a side cross-sectional view of part of a strike portion that comprises one or more cavities with parabolic inner surfaces of multiple parabolic sections, in accordance with another embodiment of a club head.

FIG. 5 illustrates a cross-sectional view of part of strike portion 500 of club head 50, where strike portion 500 comprises one or more cavities with parabolic inner surfaces having multiple parabolic sections. For example, strike portion 500 of club head 50 comprises back face 410 having cavity-set 520 with cavity 521, similar to cavity 121 (FIGS. 1-3), but differing by comprising parabolic inner surface 522 having multiple parabolic sections 5221, 5222, and 5223. Although the inner diameter of cavity 522 continuously varies in the present example, it varies at different rates based on parabolic sections 5221-5223. For example, parabolic section 5223 is steeper than parabolic section 5222, which in turn is steeper than parabolic section 5221. In a different example, more or less multiple parabolic sections can be formed to adjust a depth and/or a shape of a parabolic inner surface.

Returning to FIGS. 2-3, the cavities of cavity-set 120 can be offset to lie in-between the one or more grooves of groove-set 260. For example, in the example shown in FIG. 3, cavity 121 at back face 110 is offset to lie in-between grooves 261 and 262 at front face 250. Some or all of the cavities may be interleaved between grooves of groove-set 260. Also in the present example, subset 221 of cavity-set 120 is shown aligned substantially parallel to groove 263 of groove-set 260. In some embodiments, such arrangements can be advantageous for adding strength while reducing unwanted weight on club head 10. For example, the formation of cavity-set 120 into back face 110 can be used to remove unwanted mass to reduce or redistribute weight over strike portion 100 and/or club head 10. Such an arrangement can also be used to permit strike portion 100 to be thicker without adding weight. In the same or a different embodiment, the offset of cavity-set 120 relative to groove-set 260 can be used to add strength and/or integrity to strike portion 100. For example, when front face 250 traverses along axis of impact 370 (FIG. 3) and collides with an object such as a golf ball (not shown), resulting impact forces can be more evenly distributed over front face 250 than if cavity-set 120 were not offset as described above relative to groove-set 260. The offset of cavity-set 120 permits more mass to lie between the one or more grooves of groove-set 260 and back face 110, thereby compensating for any possible strength lost as a result of material removed while forming groove-set 260 over front face 250 of strike portion 100.

There can be examples where not all of the cavities of cavity-set 120 are offset to lie in-between the one or more grooves of groove-set 260. For example, in a different embodiment, only some of the cavities of cavity-set 120, such as those closer to a center of strike portion 100, may or need be offset as described above to achieve a desired strength, weight, or integrity goal, or otherwise. Additionally, the offset used can be partial offset where one or more edges of the one or more grooves overlap one or more edges of the cavities.

The cavities of cavity-set 120 in the present example comprise symmetry axes. For example, cavity 121 comprises symmetry axis 325 (FIG. 3) that bifurcates a parabola of parabolic inner surface 322 into symmetrical halves. As shown in FIG. 3, cavity 121 and symmetry axis 325 are substantially perpendicular to loft plane 380, back face 110, and front face 250 in the present example. In addition, cavity 121 and symmetry axis 325 are substantially parallel with axis of impact 370. Such relationships, however, may differ in other embodiments.

Figure 6:
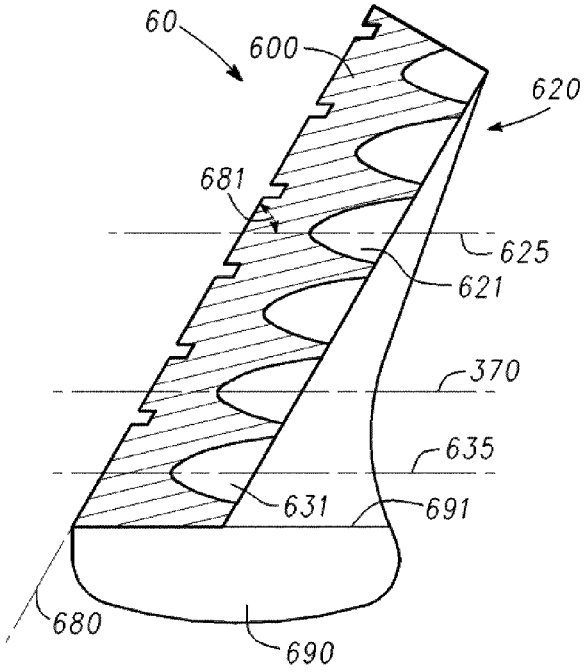
FIG. 6 illustrates a partial side cross-sectional view of part of a strike portion that has slanted cavities, in accordance with a further embodiment of a club head.

As an example of other relationships, FIG. 6 illustrates a partial cross-sectional view of part of strike portion 600 of club head 60, where strike portion 600 has slanted cavities. Strike portion 600 is similar to strike portion 100 (FIGS. 1-3), but comprises cavity-set 620 with cavities that are slanted, rather than perpendicular, relative to loft plane 680 of club head 60. For example, cavity 621 of cavity-set 620 has symmetry axis 625 that is still parallel to axis of impact 370 but slanted relative to loft plane 680. In the same and other embodiments, the slant may comprise an angle 681 of between approximately 90 and 150 degrees between symmetry axis 625 and loft plane 680. In some examples, cavity 621 and/or symmetry axis 625 may be non-parallel or slanted as well relative to axis of impact 370. In some examples, cavity 621 and/or symmetry axis 625 can be otherwise angled, such as relative to an intended initial trajectory for a golf ball impacted by club head 60.

In the present example of FIG. 6, club head 60 also comprises sole 690 at a bottom of strike portion 600. Sole 690 comprises topside 691, which in the present embodiment is substantially parallel to axis of impact 370. In the same or a different embodiment, one or more of the symmetry axes of cavity-set 620, such as symmetry axis 635 of cavity 631, can be angled such as not to intersect with topside 691 of sole 690. For example, the present embodiment presents symmetry axis 635 as substantially parallel to topside 691 of sole 690. Such a relationship can facilitate the manufacturing process of club head 60, as sole 690 would not interfere with or obstruct the formation of cavity 631 through milling, casting, forging, or other methods.

Returning to the example of FIGS. 1-3, back face 110 of strike portion 100 also comprises a plurality of ribs, such as rib 127, between the one or more cavities of cavity-set 120. In the same or a different example, the plurality of ribs can be formed or remain as a result of the formation of cavity-set 120 as offset relative to groove-set 260. In a different example, the top surface of the plurality of ribs can be higher than the surface of back face 110 and extend away from front face 250. In the same or a different example, the plurality of ribs can be substantially parallel and opposite to the one or more grooves of groove-set 260, as shown in FIG. 2.

Similar to the cavities of cavity-set 120, the plurality of ribs can also be angled relative to a loft plane and/or an axis of impact. For example, rib 127 is shown in FIG. 3 as parallel to axis of impact 370 and perpendicular to back face 110 and loft plane 380. In a different example, such as shown in FIG. 6, rib 627 can be similar to rib 127, but slanted instead of perpendicular relative to loft plane 680 of club head 60. In another example, rib 627 could also be slanted relative to axis of impact 370.

Figure 7:
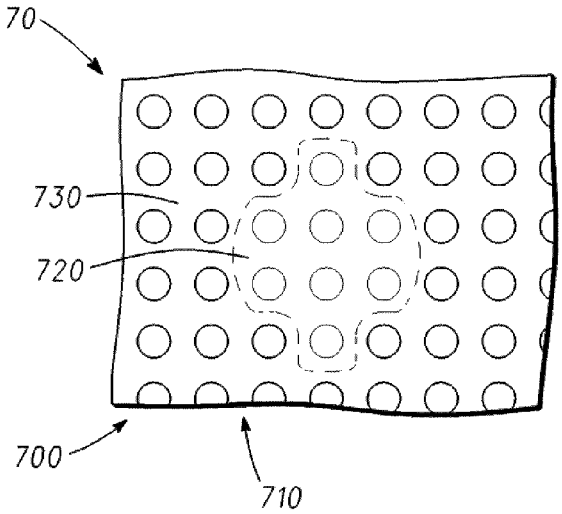
FIG. 7 illustrates a back face view of part of a strike portion that comprises at least two cavity-sets that differ from each other based on depth, in accordance with another embodiment.

Moving on with the figures, FIG. 7 illustrates a back face view of a strike portion 700 of a club head 70, where strike portion 700 comprises at least two cavity-sets that differ from each other based on depth. Strike portion 700 can be similar to strike portion 100; and comprises back face 710 having cavity-set 720 similar to cavity-set 120 (FIGS. 1-3). Strike portion 700 differs by further comprising cavity-set 730, where cavity-set 730 comprises one or more cavities different than the one or more cavities of cavity-set 720 and/or 120 (FIG. 1). For example, in the present embodiment, cavity-set 730 comprises cavities that are deeper than the cavities of cavity-set 720. Also in the present embodiment, cavity-set 720, with its shallower cavities, is positioned closer to a center of strike portion 700 than cavity-set 730. In the same of a different example, the shallower cavities of cavity-set 720 can be arranged at or behind one or more areas of strike portion 700 that are more likely to experience higher stresses upon impact with an object such as a golf ball. Such a configuration permits material to be removed from back face 710 while still allowing additional strength to absorb and disperse stresses where needed. Cavity-set 730, with its deeper cavities, also can be arranged elsewhere where less stress is likely to be absorbed by strike portion 700.

In the same or a different example, strike portion 700 can comprise a further cavity-set (not shown) with cavities deeper than the cavities of cavity-set 730. Such further cavity-set can be located, for example further away than cavity-set 730 from the center of strike portion 700.

Figure 8:
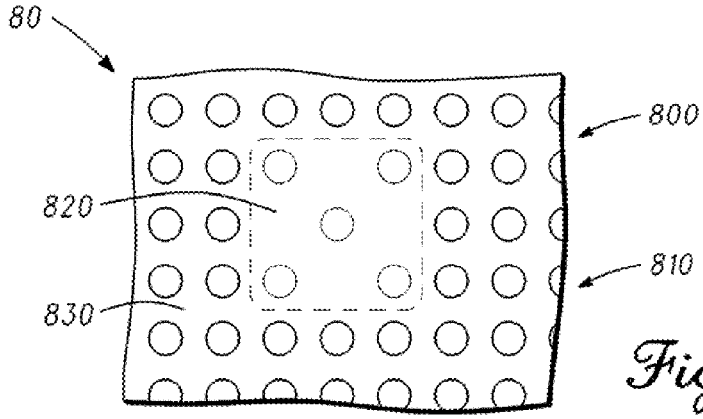
FIG. 8 illustrates a back face view of part of a strike portion that comprises at least two cavity-sets that differ from each other based on concentration, in accordance with another embodiment.

FIG. 8 illustrates a back face view of a strike portion 800 of club head 80, where strike portion 800 comprises at least two cavity-sets that differ from each other based on concentration. Strike portion 800 can be similar to strike portion 100, and comprises back face 810 having cavity-set 820 similar to cavity-set 120 (FIGS. 1-3). Strike portion 800 differs by further comprising cavity-set 830, where cavity-set 830 comprises one or more cavities that are more concentrated or denser than the cavities of cavity-set 820. In some embodiments, the cavities of cavity-set 830 may also be deeper than the cavities of cavity-set 820. Cavity-set 820, with its more dispersed cavities, is positioned closer to a center of strike portion 800 than cavity set 830 in the present embodiment. In the same of a different example, the more dispersed cavities of cavity-set 820 can be arranged at or behind one or more areas of strike portion 800 that are more likely to experience higher stresses upon impact with an object such as a golf ball. The extra dispersion between the cavities of cavity-set 820 permits more material to be present to provide additional strength for absorbing and/or dispersing stresses where needed. Cavity-set 830, with its more concentrated or denser cavities, also can be arranged elsewhere where less stress is likely to be absorbed by strike portion 800.

In the same or a different example, strike portion 800 can comprise a further cavity-set (not shown) with more concentrated or denser cavity arrangements than the cavities of cavity-set 830. Such further cavity-set can be located, for example further away than cavity-set 830 from the center of strike portion 800.

Figure 9:
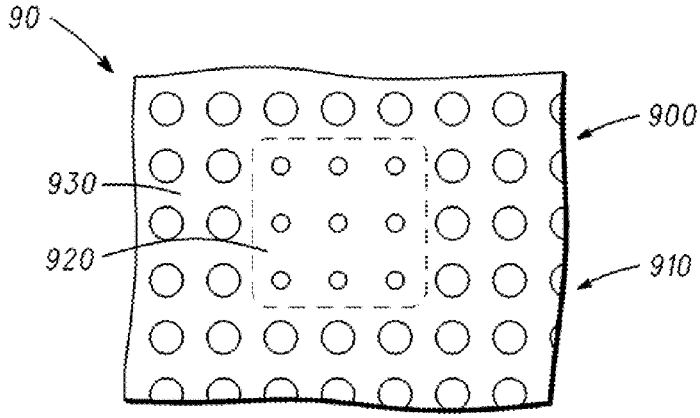
FIG. 9 illustrates a back face view of part of a strike portion that comprises at least two cavity-sets that differ from each other based on size, in accordance with another embodiment.

FIG. 9 illustrates a back face view of a strike portion 900 of club head 90, where strike portion 900 comprises at least two cavity-sets that differ from each other based on size. Strike portion 900 can be similar to strike portion 100, and comprises back face 910 having cavity-set 920 similar to cavity-set 120 (FIGS. 1-3). Strike portion 700 differs by further comprising cavity-set 930, where cavity-set 930 comprises one or more cavities larger and/or broader than the cavities of cavity-set 920. In some examples, the cavities of cavity-set 930 can also be deeper and/or more concentrated than the cavities of cavity-set 920. Cavity-set 920, with its smaller and/or narrower cavities, is positioned closer to a center of strike portion 900 than cavity-set 930. In the same of a different example, the smaller or narrower cavities of cavity-set 920 can be arranged at or behind one or more areas of strike portion 900 that are more likely to experience higher stresses upon impact with an object such as a golf ball. The smaller size and/or narrowness of the cavities of cavity-set 920 permits more material to be present to provide additional strength for absorbing and/or dispersing stresses where needed. Cavity-set 930, with its larger and/or broader cavities, also can be arranged elsewhere where less stress is likely to be absorbed by strike portion 900.

In the same or a different example, strike portion 900 can comprise a further cavity-set (not shown) with cavities that are even larger and/or broader than the cavities of cavity-set 930. Such further cavity-set can be located, for example further away than cavity-set 930 from the center of strike portion 900.

Although FIGS. 7-9 respectively illustrate cavity-sets 720, 820, and 920 as comprising a certain number of cavities enclosed within a certain shape of a dotted-line, in other embodiments, cavity-sets 720, 820, and/or 920 can comprise more or less cavities forming different patterns and can be at locations other than the center of strike portions 700, 800, or 900.

Figure 10:
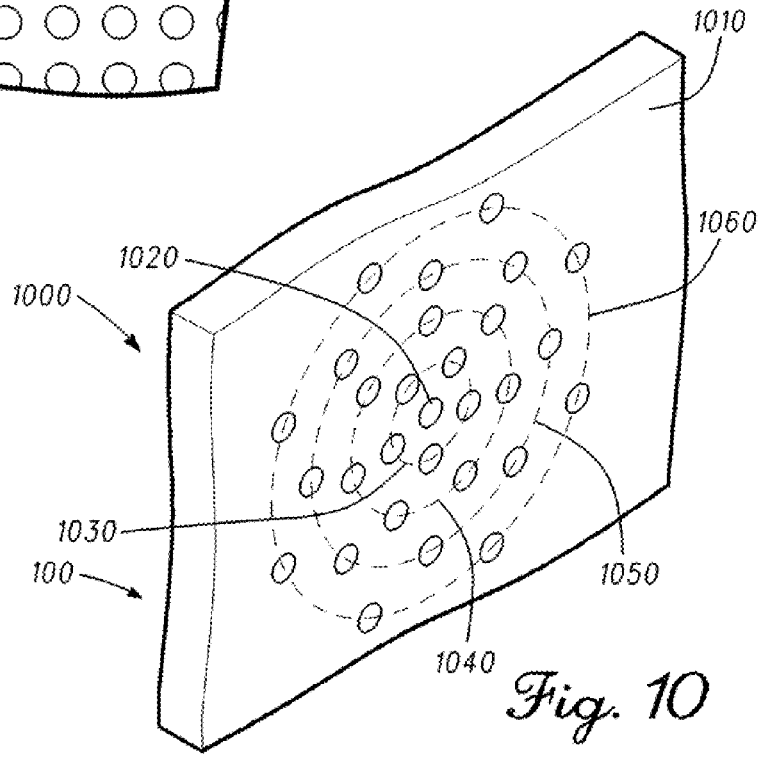
FIG. 10 illustrates a perspective view of part of a strike portion that comprises cavities arranged in concentric arcuate patterns, in accordance with another embodiment.

Continuing with the figures, FIG. 10 illustrates a perspective view of back face 1010 of strike portion 1000 of club head 100. Back face 1010 comprises cavities arranged in a concentric or arcuate pattern, and in the present embodiment, the cavities are arranged into different cavity-sets as defined by the dashed-lines of FIG. 10. As shown in FIG. 10, the concentric or arcuate pattern can be circular, although other arrangements are possible, such as ellipsoidal, parabolic, or semi-circular. In the present example, back face 1010 comprises cavity-sets 1020, 1030, 1040, 1050, and 1060, each progressively further away from a center of strike portion 1000. In the same or a different embodiment, the cavities of cavity-sets 1020, 1030, 1040, 1050, and 1060 can comprise different characteristics from one cavity-set to another. For example, the cavities may become progressively deeper or shallower from cavity-set 1020 to cavity-set 1060. In the same or a different embodiment, the cavities may become progressively more or less concentrated from cavity-set 1020 to cavity-set 1060. In the same or a different embodiment, the cavities may become smaller/narrower or larger/broader from cavity-set 1020 to cavity-set 1060. The dotted lines and any particular subdivision of cavity-sets in FIG. 10 are for illustration purposes only, and other implementations of the same concept may be practiced without departing from the present disclosure. In other embodiments, different aspects of the various cavities in FIGS. 1-10 can be combined together.

Moving along, FIG. 11 illustrates a flowchart of a method 1100 for manufacturing a club head. In some embodiments, the club head of method 1100 can be one of club heads 10 (FIGS. 1-3), 40 (FIG. 4), 50 (FIG. 5), 60 (FIG. 6), 70 (FIG. 7), 80 (FIG. 8), 90 (FIG. 9), and/or 100 (FIG. 10), as described above. In some embodiments, the golf club head of method 1100 can be a driver-type head, a putter-type head, a wedge-type head, an iron-type head, a hybrid-type head, and/or a fairway wood-type head, among others.

Block 1110 of method 1100 comprises providing a strike portion with a front face and a back face. In some embodiments, the strike portion can be strike portion 100 (FIGS. 1-3), 400 (FIG. 4), 500 (FIG. 5), 600 (FIG. 6), 700 (FIG. 7), 800 (FIG. 8), 900 (FIG. 9), and/or 1000 (FIG. 10) as described above, along with their respective front faces and back faces. For example, the front face can be front face 250 of strike portion 100, and the back face can be back face 110 of strike portion 100 (FIGS. 1-3).

In some examples, method 1100 can comprise block 1111, which comprises forming a plurality of furrows at the front face of the strike portion. As an example, the plurality of furrows can be the one or more grooves of groove-set 260 (FIGS. 2-3). Also, in some examples, blocks 1110 and 1111 can be performed simultaneously with each other. In other examples, block 1111 can be skipped or left out of method 1100.

Next, block 1120 of method 1100 comprises providing a sole coupled to the strike portion. In some embodiments, the sole can be similar to sole 690 of club head 60 (FIG. 6) as described above. In the same or a different example, a topside of the sole can relate to an axis of impact and/or a loft plane of the club head as described above for topside 691 of sole 690 (FIG. 6). Block 1120 can be optional in some examples of method 1100, or in other examples, block 1120 can be performed simultaneously with blocks 1110 and 1111 (or with only block 1110 when 1111 is skipped).

Subsequently, block 1130 of method 1100 comprises forming a plurality of parabolic cavities into the back face. The plurality of parabolic cavities can be, in some examples, at least part of the one or more cavities of cavity-set 120 (FIGS. 1-3), 420 (FIG. 4), 620 (FIG. 6), 720 (FIG. 7), 820 (FIG. 8), 920 (FIG. 9), and/or 1020 (FIG. 10) as described above. In some embodiments, some or all of the parabolic cavities can comprise multiple parabolic surfaces, as described for example with respect to cavity 521 in FIG. 5. One or more of the cavities of the cavity-set can comprise symmetry axes similar to symmetry axis 635 (FIG. 6). In examples where method 1100 comprises block 1120, the topside of the sole can also relate to one or more symmetry axes of the parabolic cavities as described above.

In some examples of block 1130, the parabolic cavities can be formed by drilling or milling into the back face. Such a process can be performed in some examples with an end mill comprising a parabolic tip. In another example, the parabolic cavities can be formed via a casting process, such as by using a mold configured to form the cavities out of deposited material. In yet another example, the parabolic cavities fan be formed via a forging process, such as by striking the back face with a hammer die. The examples of manufacturing methods above are exemplary, however, and the present disclosure is not limited to these manufacturing methods.

Continuing with method 1100, block 1130 can comprise one or more of blocks 1131-1138. Block 1131 comprises arranging the plurality of parabolic cavities to interleave between the plurality of furrows of block 1111. Block 1131 is optional, and can depend on whether block 1111 is carried out. In some examples, the parabolic cavities can be arranged to interleave as described for FIGS. 3-6. For example, in FIGS. 2-3, cavity 121 is shown interleaved between grooves 261 and 262 of groove-set 260. Such an arrangement leaves more material between the cavities, and can compensate for lower strength or integrity due to material removed when forming the furrows.

Block 1132 of method 1100 comprises arranging the plurality of parabolic cavities substantially parallel to one or more of the plurality of furrows. Block 1132 is optional, and can be accomplished as illustrated in FIG. 2, for example, where subset 221 of cavity-set 120 is shown aligned substantially parallel to groove 263 of groove-set 260.

Block 1133 of method 1100 comprises aligning one or more symmetry axes of the plurality of parabolic cavities to be slanted relative to a loft plane of the club head. Although block 1132 can be optional, it can be accomplished as illustrated in FIG. 6, where symmetry axis 625 of cavity 621 is slanted and non-perpendicular to loft plane 680.

Block 1134 of method 1100 comprises aligning one or more symmetry axes of the parabolic cavities to forego intersecting with a topside plane of the sole. Block 1134 is optional, and can be performed as shown in FIG. 6, where symmetry axis 631 is substantially parallel to topside 691 of sole 690, thereby preventing intersection with topside 691. Other angular non-parallel relationships between topside 691 and symmetry axis 631 are possible where intersection can still be avoided to, for example, facilitate the manufacturing process of the cavities as described above.

Block 1135 of method 1100 comprises forming the plurality of parabolic cavities with decreasing depths toward a center of the strike portion. Block 1135 is optional, but can be carried out as described for FIG. 7, where the cavities at back face 710 decrease in depth, from deeper cavities in cavity-set 730 to shallower cavities in cavity-set 720, as they approach the center of strike portion 700. In other examples, the cavities at back face 710 can decrease in depth more gradually, even one-by-one, as they successively get closer to the center of strike portion 700.

Block 1136 of method 1100 comprises forming the plurality of parabolic cavities in decreasing concentration towards a center of the strike portion. Block 1136 is optional, but can be carried out as described for FIG. 8, where the cavities at back face 810 decrease in concentration or density, from denser or more concentrated cavities in cavity-set 830 to cavities that are further spread apart in cavity-set 820, as they approach the center of strike portion 800. In other examples, the cavities on back face 810 can decrease in concentration or density more gradually, even one-by-one, as they successively get closer to the center of strike portion 800.

Block 1137 of method 1100 comprises forming the plurality of parabolic cavities with decreasing sizes toward a center of the strike portion. Block 1137 is optional, but can be carried out as described for FIG. 9, where the cavities on back face 910 decrease in size, from larger or broader cavities in cavity-set 930 to smaller or narrower cavities in cavity-set 920, as they approach the center of strike portion 900. In other examples, the cavities at back face 910 can decrease in size gradually, even one-by-one, as they successively get closer to the center of strike portion 900.

Block 1138 of method 1100 comprises arranging the plurality of parabolic cavities in a substantially concentric arcuate pattern along the back face of the strike portion. In some examples, the concentric arcuate pattern can be circular, parabolic, or ellipsoidal. Although block 1138 is optional, it can be accomplished as described in FIG. 10, where cavity-sets 1020, 1030, 1040, 1050, and 1060 form concentric sets of concentric cavities in strike portion 1000.

In some examples, one or more of the different blocks of method 1100 can be combined into a single step. For example, as described above, blocks 1110 and 1120 can be combined into a single block in cases where the sole is preformed along with the strike portion. In the same or a different example, the sequence of one or more of the different blocks of method 1100 can be changed. As an example, the sequence of blocks 1135-1137 can be altered in some examples without affecting the end product. As another example, the sequence of blocks 1111, 1120, and 1130 can be reversed or changed into a different order. In the same or a different example, method 1100 can comprise further or different steps, such as coupling the strike portion to a club head and/or to a club shaft.

Figure 12:
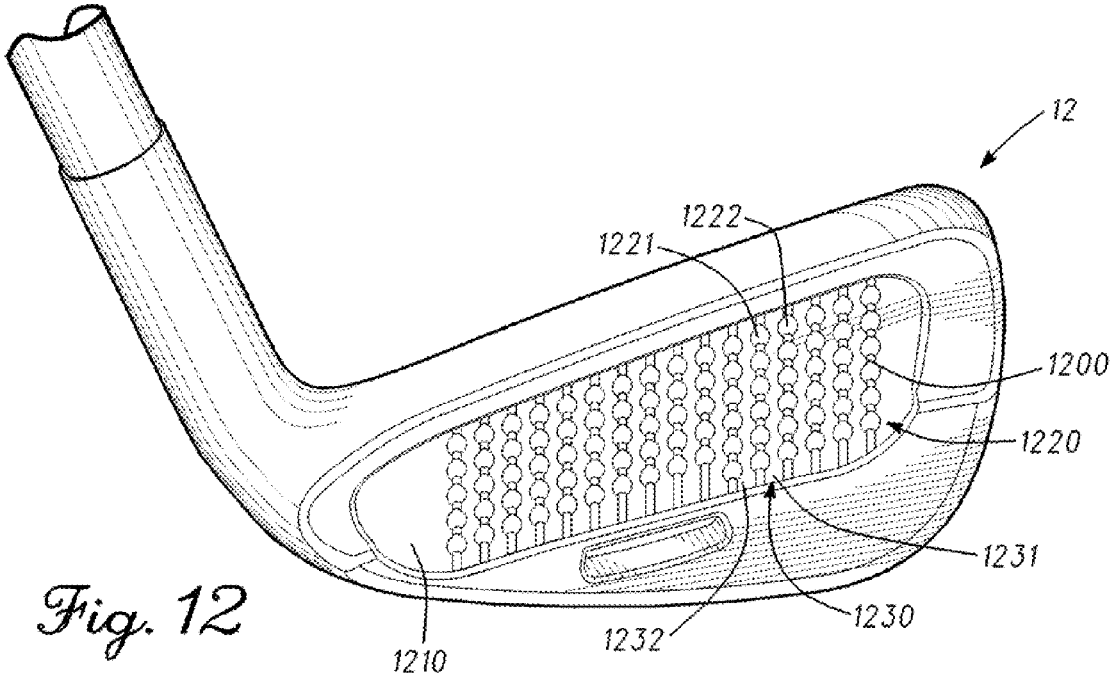
FIG. 12 illustrates a rear perspective view of a club with a club head and a strike portion, where the strike portion comprises a trench-set in accordance with a further embodiment of a club head.
Figure 13:
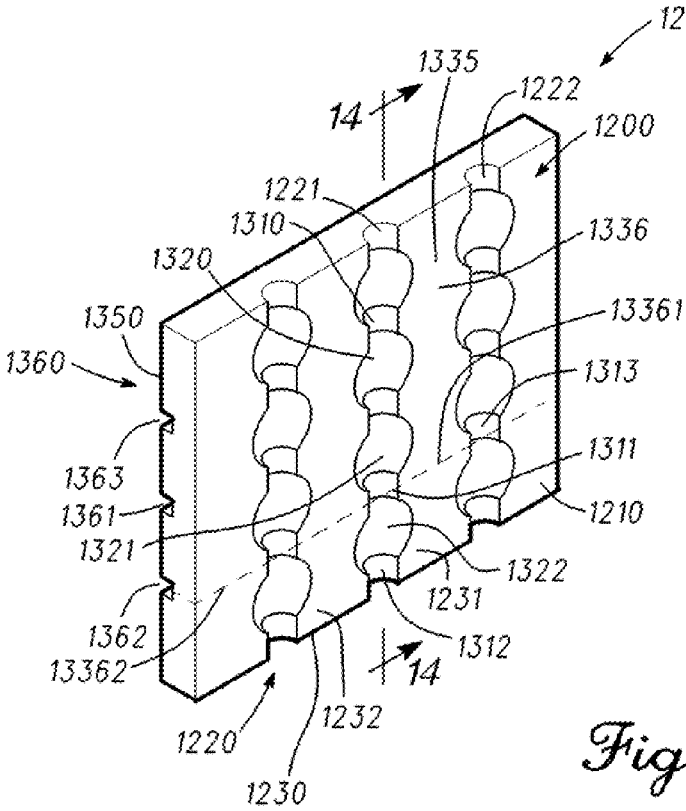
FIG. 13 illustrates a perspective cross-sectional view of part of the strike portion of FIG. 12.
Figure 14:
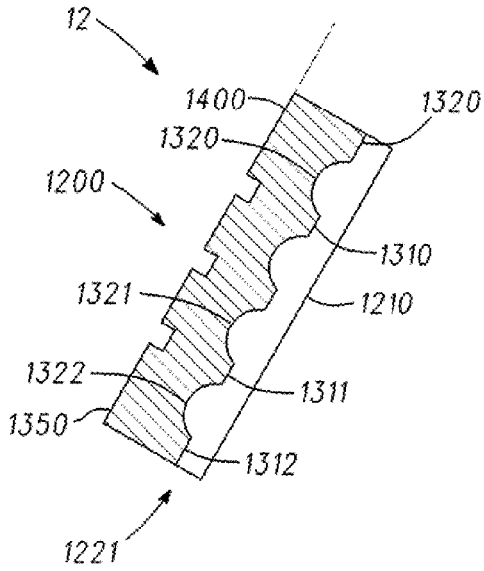
FIG. 14 illustrates a cross-sectional side view of the strike portion of FIG. 3 along a cross-sectional line 14-14.

Moving on, FIG. 12 illustrates a rear perspective view of a club with club head 12 and strike portion 1200, where strike portion 1200 comprises trench-set 1220. The front perspective view of club head 12 can be similar to the front perspective view of club head 10 in FIG. 30. FIG. 13 illustrates a perspective cross-sectional view of part of strike portion 1200 of club head 12. FIG. 14 illustrates a cross-sectional view of part of strike portion 1200 along cross-sectional line 14-14 in FIG. 13. Parts of the club and/or of club head 12 may be omitted from FIGS. 12-14 for clarity.

Club head 12 can be similar to club head 10 (FIGS. 1-3), described above, but back face 1210 of strike portion 1200 comprises trench-set 1220, rather than cavity-set 120 (FIGS. 1-3). In the present embodiment, strike portion 1200 also comprises strike face 1350 opposite back face 1210, where strike face 1350 can be similar to front face 250 (FIGS. 2-3 and 30). Strike face 1350 comprises one or more grooves 1360, similar to groove-set 260 (FIGS. 1-3). Groove-set 1360 comprises grooves 1361, 1362, and 1363 in the present embodiment.

Trench-set 1220 comprises one or more trenches, of which at least trench 1221 comprises shallow portion set 1310 and deep portion set 1320. In the present example, shallow portion set 1310 comprises shallow portions 1311, 1312, and deep portion set 1320 comprises deep portion 1321-1322, where shallow portions 1311-1312 are shallower than deep portions 1321-1322 relative to back face 1210. Also in the present embodiment, shallow portions 1310 are shown alternating with deep portions 1320 along a length of trench 1221. In a different embodiment, shallow portions 1310 and deep portions 1320 may alternate with other portions of trench 1221 of even deeper and/or shallower dimensions.

The example of FIGS. 12-14 also shows shallow portions 1310 and deep portions 1320 as comprising parabolic shapes. As an example, shallow portions 1310 can have convex parabolic shapes, and deep portions 1320 can have concave parabolic shapes. Forming parabolic shapes or surfaces as part of at least some of the trenches of trench-set 1220 can provide beneficial effects with respect to the strength or ability of strike portion 1200 to absorb and/or dissipate stress forces upon impact, for example, with a golf ball. For example, principles similar to those described earlier for the parabolic inner surfaces and/or shapes of cavity-sets 120 (FIGS. 1-3), 420 (FIG. 4), 520 (FIG. 5), 620 (FIG. 6), 720 (FIG. 7), 820 (FIG. 8), 920 (FIG. 9), and/or 1020 (FIG. 10) can be used on parabolic surfaces of shallow and deep portions 1310 and/or 1320 to enhance the strength and/or stress-dissipating ability of strike portion 1200. In other examples, only part or some of deep portions 1320 or shallow portions 1310 may comprise parabolic shapes. For example, in one embodiment, deep portions 1320 can have one or more parabolic shapes, and shallow portions 1310 can be devoid of all parabolic shapes. Additionally, some embodiments can be entirely devoid of parabolic shapes.

In the present example, the one or more trenches of trench-set 1220 also comprise trench 1222 substantially parallel to trench 1221. Trench-set 1220 also comprises one or more ribs 1230, such as rib 1231. Rib 1231 is located between trenches 1221 and 1222, and comprises one or more narrow portions 1335 and one or more wide portions 1336 wider than narrow portions 1335. Ribs 1230 can comprise other ribs similar to rib 1231, such as rib 1232, in the illustrated embodiment, and can also comprise other ribs without corresponding wide or narrow portions in other embodiments.

The present embodiment shows that at least some of the one or more ribs 1230 comprise wide portions 1336 that can be positioned substantially opposite to a groove of groove-set 1360. For example, ribs 1231 and 1232 comprise wide portions 13361 and 13362, respectively, aligned substantially parallel and opposite to groove 1362 of groove-set 1360.

In the same example, at least some of the one or more trenches of trench-set 1220 each comprise shallow portions 1310 positioned substantially opposite to a groove of groove-set 1360. For example, trench 1221 comprises shallow portion 1311, while trench 1222 comprises shallow portion 1313, where both shallow portions 1311 and 1313 are aligned substantially parallel and opposite to groove 1361 of groove-set 1360.

The described alignments, and similar others relative to grooves of groove-set 1360, can be beneficial to provide further strength or stress-dissipating ability to strike portion 1200. As an example, thick portions 13361 and 13362 of ribs 1231 and 1232, and/or shallow portions 1311 and 1312 of trenches 1221 and 1222, can provide additional material behind groove 1361 to compensate for other material removed during formation of groove 1361. In some examples, such arrangements can also allow a thickness and/or weight of strike portion 1200 to be reduced without compromising strength or integrity, similar to the benefits provided by the arrangement of cavity-set 120 (FIGS. 1-3), as described above.

Figure 15:
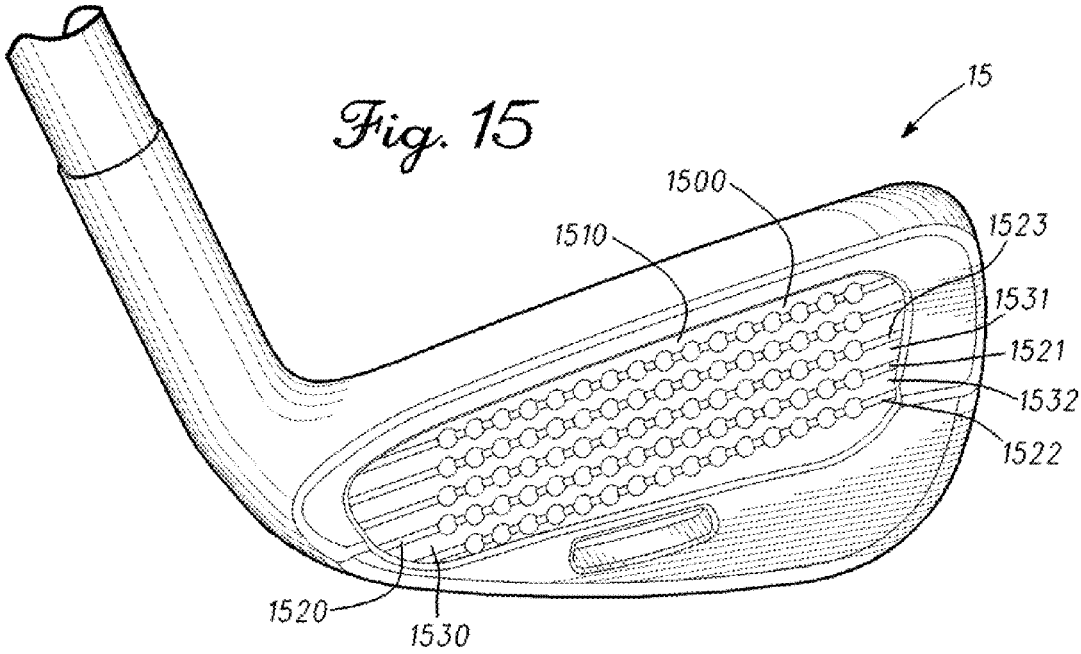
FIG. 15 illustrates a perspective view of a club with a club head and a strike portion, where the strike portion comprises another trench-set, in accordance with a different embodiment of a club head.

Continuing with the figures, FIG. 15 illustrates a perspective view of a club with club head 15 and strike portion 1500. FIG. 16 illustrates a perspective cross-sectional view of part of strike portion 1500 of club head 15. FIG. 17 illustrates a cross-sectional view of part of strike portion 1500 along cross-sectional line 17-17 in FIG. 16. FIG. 18 illustrates a cross-sectional view of part of strike portion 1500 along cross-sectional line 18-18 in FIG. 16. Parts of the club and/or of club head 15 may be omitted from FIGS. 15-18 for clarity.

Club head 15 can be similar to club head 12 (FIGS. 12-14), described above. For example, in the present embodiment, strike portion 1500 also comprises strike face 1350, as described above for club head 12. Back face 1510 of strike portion 1500, however, comprises trench-set 1520, rather than trench-set 1220 (FIGS. 12-14), where trench-set 1520 is substantially parallel to at least groove 1361 of groove-set 1360 in the present example. In other aspects, back face 1510 of strike portion 1500 can be similar to back face 1210 of strike portion 1200 (FIGS. 12-14). As an example, trench-set 1520 comprises trenches 1521-23 with shallow portion set 1610 and deep portion set 1620, similar to shallow portion set 1310 and deep portion set 1320 of trench 1221 (FIG. 13).

Strike portion 1510 also comprises rib set 1530 at back face 1510. Rib set 1530 can be similar to rib set 1230 (FIGS. 12-14), but is oriented differently. For example, in the present embodiment, rib set 1530 comprises ribs 1531 and 1532, among other ribs, positioned substantially parallel and opposite to grooves 1361 and 1362 of groove-set 1360, respectively.

FIGS. 17-18 provide another vantage point from which to appreciate the relationship between deep portions 1620, shallow portions 1610, and rib set 1530. The cross-sectional view in FIG. 17 along cross-sectional line 17-17 in FIG. 16 cuts across deep portions 1620 of trenches 1521-1523 of trench-set 1520, while the cross-sectional view in FIG. 18 along cross-sectional line 18-18 in FIG. 16 cuts across shallow portions 1610 of trenches 1521-1523. As can be seen from FIGS. 17-18 in combination, a distance 1710 between strike face 1350 and one of deep portions 1620 of trench 1521 is shorter than a distance 1810 between strike face 1350 and one of shallow portions 1610 of the same trench. Similarly, distances 1820 between adjacent ones of shallow portions 1610 of trenches 1521 and 1522 is greater than distances 1720 between adjacent ones of deep portions 1620 of the same trenches. In some embodiments, as will be described further below, such relationships may be taken in consideration when positioning deep and/or shallow portions of trench-set 1520 at areas of higher expected stress incidence.

Continuing with the present example, trenches 1521-1523 of trench-set 1520 are interleaved with grooves 1361 and 1362. Such an arrangement can be beneficial for promoting the strength and integrity of strike portion 1500. For example, extra material encompassed by the ribs of rib set 1530 opposite the grooves of groove-set 1360 can provide additional strength and/or integrity behind individual grooves of groove-set 1360 to compensate for other material removed during formation of groove-set 1360. In other examples, no special alignment or relationship need exist between groove-set 1360 and rib set 1530 or trench-set 1520. In such examples, nevertheless, rib set 1530 and/or trench-set 1520 could still provide structural and/or weight benefits to strike portion 1500 as described above for rib set 1230 and/or trench-set 1220 (FIGS. 12-14).

Moving along, FIG. 19 illustrates a cross-sectional view of strike portion 1900 of club head 19. Club head 19 is similar to club head 15 (FIGS. 15-18), but comprises trench-set 1920 and rib set 1930. Although similar to trench-set 1520 and rib set 1530 (FIGS. 15-18), respectively, trench-set 1920 and rib set 1930 comprise at least some trenches and ribs that are slanted relative to loft plane 1980, whereas the trenches and ribs of trench-set 1520 and rib set 1530 were shown as substantially perpendicular to back face 1510 in FIG. 18. For example, trenches 1921, 1922, and 1923 comprise symmetry axes 1950 that are slanted and non-perpendicular to back face 1910 and to loft plane 1980. Similarly, ribs 1931 and 1932 comprise bodies that are slanted relative to back face 1910 and loft plane 1980. In the present example, bodies 1960 and symmetry axes 1950 are also substantially parallel to axis of impact 370, although in a different embodiment they may be angled in a different manner, such as for example relative to and/or substantially collinear with an intended initial trajectory for a golf ball impacted by club head 19.

Figure 20:
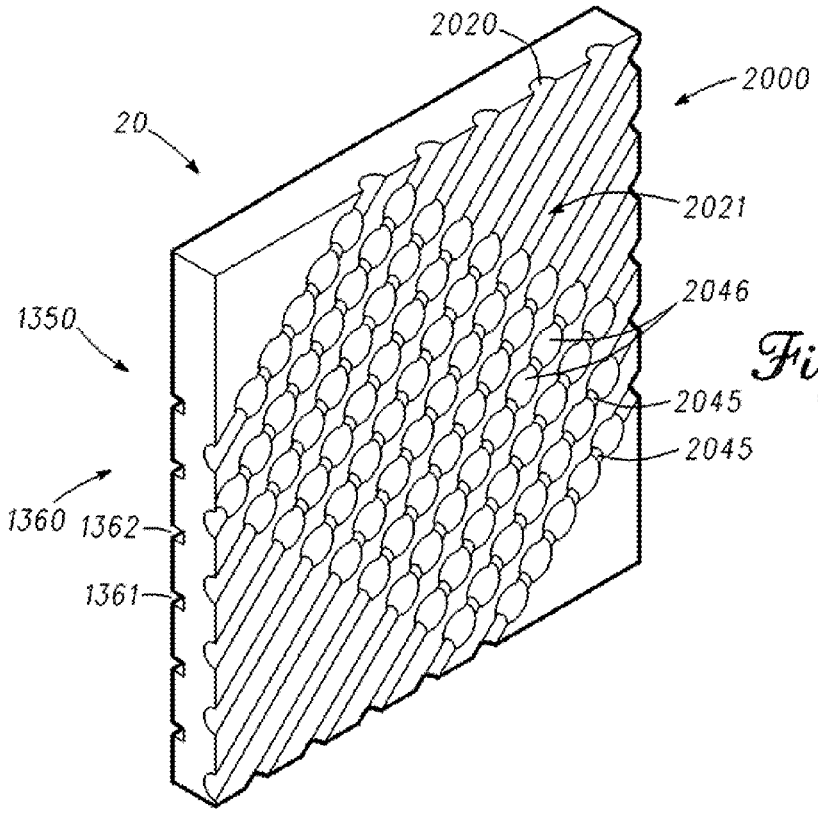
FIG. 20 illustrates a perspective view of part of a strike portion of a club head, where the strike portion comprises a trench set that is angled diagonally, in accordance with another embodiment.

Forging ahead, FIG. 20 illustrates a perspective view of part of strike portion 2000 of club head 20. Strike portion 2000 is similar to strike portion 1200 (FIGS. 12-14), but comprises trench-set 2020 angled diagonally relative to at least one groove of groove-set 1360, such as any of grooves 1361-1362. Trench-set 2020 comprises trench 2021, deep portions 2046, and shallow portions 2045, similar to trench-set 1220, trench 1221, deep portions 1320, and shallow portions 1310 (FIGS. 12-14), respectively. Though angled differently than trench-sets 1220 (FIGS. 12-14) and 1520 (FIG. 15-18) described above, trench-set 2020 can be implemented to provide benefits similar to those described above for trench-sets previously discussed.

Figure 21:
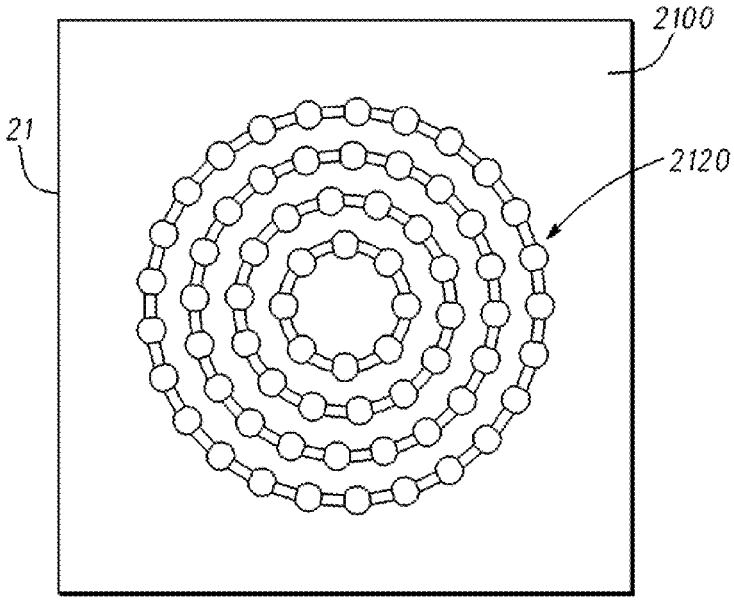
FIG. 21 illustrates a perspective view of part of a strike portion of a club head, where the strike portion comprises a trench-set with concentric trenches, in accordance with another embodiment.

Other embodiments may comprise trench-sets at angles different than perpendicular, parallel, or diagonal relative to groove-set 1360. For example, FIG. 21 illustrates a perspective view of part of a strike portion 2100 of a club head 21. Strike portion 2100 comprises trench-set 2120, which can be similar to trench-set 1220 (FIGS. 12-14), but with concentric trenches relative to a center of strike portion 2100. In some examples, distances between different trenches, and/or depths or sizes of different trenches of trench-set 2120 can be varied based on different criteria, such as the location of areas of higher expected stress incident on strike portion 2100.

In some embodiments, some or all of the trench-sets previously described can be adjusted and/or implemented for further purposes, such as for tuning the sound or the face response of their respective club heads upon impact with an object such as a golf ball.

Figure 22:
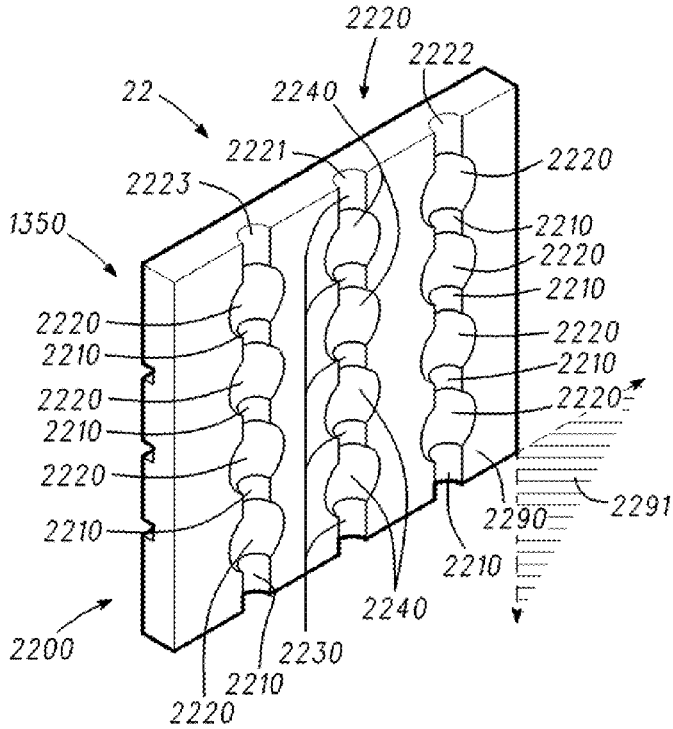
FIG. 22 illustrates a perspective view of part of a strike portion of a club head, where the strike portion comprises a trench-set with trenches that can differ from each other based on depth, in accordance with another embodiment.

Continuing through the figures, FIG. 22 illustrates a perspective view of part of strike portion 2200 of club head 22. Strike portion 2200 is similar to strike portion 1200 (FIGS. 12-14), and comprises trench-set 2220 similar to trench-set 1220 (FIGS. 12-14). In the present example, however, some trenches of trench-set 2220 may differ from each other. For example, trench-set 2220 comprises trenches 2222 and 2223, each comprising shallow portion set 2210 and deep portion set 2220. In addition, trench-set 2220 comprises trench 2221, comprising shallow portion set 2230 and deep portion set 2240.

In the present embodiment, strike portion 2200 comprises the following characteristics: (1) shallow portion set 2230 is shallower than deep portion set 2240 relative to back face plane 2291, where back face plane 2291 is parallel to a loft plane of club head 22 even if back face 2290 is not; (2) shallow portion set 2230 is shallower than shallow portion set 2210 relative to back face plane 2291; and (3) deep portion set 2240 is shallower than deep portion set 2220 relative to back face plane 2291.

In addition, at least in the present embodiment, part of shallow portion set 2230 is positioned closer to a center of strike portion 2200 than part of shallow portion set 2210. Also, part of deep portion set 2240 is positioned closer to the center of strike portion 2200 than part of deep portion set 2220.

As a result, trench 2221 is shallower overall than any of trenches 2222 and 2223. Trench 2221, with its shallower shallow portion set 2230 and shallower deep portion set 2240, is also located closer to a center of strike portion 2200 in the present example. This arrangement can provide more material for further strength and/or structural integrity to the center of strike portion 2200, an area in the present example where heightened stress incidence is expected when impacting an object with strike face 1350.

Figure 23:
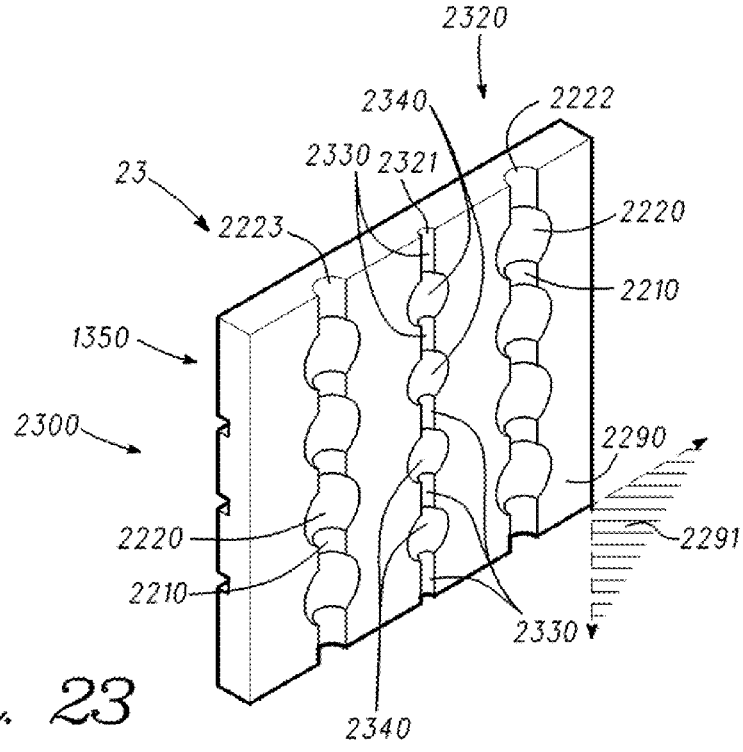
FIG. 23 illustrates a perspective view of part of a strike portion of a club head, where the strike portion comprises a trench-set with trenches that can differ from each other based on width, in accordance with another embodiment.

FIG. 23 illustrates a perspective view of part of strike portion 2300 of club head 23. Strike portion 2300 is similar to strike portion 2200 (FIG. 22), and comprises trench-set 2320 similar to trench-set 2220 (FIG. 22). Trench-set 2320 also comprises trenches 2222 and 2223, but trench 2221 (FIG. 22) is replaced with trench 2321, thus differing from trench-set 2220 (FIG. 22). In some examples, trench 2321 could be considered to form part of another trench set different than trench-set 2320. Trench 2321 comprises shallow portion set 2330 and deep portion set 2340.

In the present embodiment, strike portion 2300 comprises the following characteristics: (1) shallow portion set 2330 is shallower than deep portion set 2340 relative to back face plane 2291; (2) shallow portion set 2330 is narrower than shallow portion set 2210; and (3) deep portion set 2340 is narrower than deep portion set 2220.

In addition, at least in the present embodiment, part of shallow portion set 2330 is positioned closer to a center of strike portion 2300 than part of shallow portion set 2210. Also, part of deep portion set 2340 is positioned closer to the center of strike portion 2300 than part of deep portion set 2220.

As a result, trench 2321 is narrower overall than any of trenches 2222 and 2223. Trench 2321, with its narrower shallow portions 2230 and narrower deep portions 2240, is also located closer to a center of strike portion 2200 in the present example. Such an arrangement can provide further strength or integrity where needed, much as described above for strike portion 2200.

FIG. 24 illustrates a perspective view of part of strike portion 2400 of club head 24. Strike portion 2400 can be similar to strike portions 1200 (FIGS. 12-14), 2200 (FIG. 22), and/or 2300 (FIG. 23), among others, but comprises more than one trench-set. Trench-sets 2420 and 2450 of strike portion 2400 can be similar to other trench-sets described above, but differ from each other. As an example, trench-set 2420 comprises trenches spaced apart from each other by distance 2421, while trench-set 2450 comprises trenches spaced apart from each other by distance 2451, where distance 2451 is greater than distance 2421. As a result, ribs between trenches of trench-set 2450 can be broader or wider than ribs between trenches of trench-set 2420.

The relationship between the different trenches of strike portion 2400 can be manipulated, for example, to provide further material to absorb or dissipate stress forces induced onto certain portions of strike portion 2400. Trench-set 2450, with its more massive ribs, is positioned in the present embodiment closer than trench-set 2420 to a center of strike portion 2400 to better absorb stresses in this area of strike portion 2400. Trench-set 2420, with its more concentrated trenches and narrower ribs can be positioned further away from heightened stress zones to allow further removal of material without adversely affecting the strength or integrity of strike portion 2400.

Moving on, FIG. 25 illustrates a perspective view of part of strike portion 2500 of club head 25. Strike portion 2500 is similar to strike portion 2200 (FIG. 22), comprising trench-set 2520 similar to trench-set 2220 (FIG. 22). Trench-set 2520 also comprises trenches 2222 and 2223, but trench 2221 (FIG. 22) is replaced with trench 2521, thus differing from trench-set 2220 (FIG. 22). In some examples, trench 2521 could be considered to form part of another trench set different than trench-set 2520. In the example of FIG. 25, trench 2521 comprises two shallow portion sets 2210 and 2530, and two deep portion sets 2220 and 2540.

In the present embodiment, strike portion 2500 comprises the following characteristics: (1) shallow portion set 2530 is shallower than deep portion set 2540 relative to back face plane 2291; (2) shallow portion set 2530 is shallower than shallow portion set 2210 relative to back face plane 2291; and (3) deep portion set 2540 is shallower than deep portion set 2220 relative to back face plane 2291.

In addition, at least in the present embodiment, part of shallow portion set 2530 is positioned closer to a center of strike portion 2500 than part of shallow portion set 2210. Also, part of deep portion set 2540 is positioned closer to the center of strike portion 2500 than part of deep portion set 2220.

As a result, trench 2521 comprises relatively shallower portions closer to a center of strike portion 2500, and relatively deeper portions further away from said area. This configuration can serve in some embodiments to bolster the integrity and/or stress-absorbing characteristics of strike portion 2500 closer to areas of higher expected stresses induced upon impact of strike portion 2500 with other objects.

Figure 26:
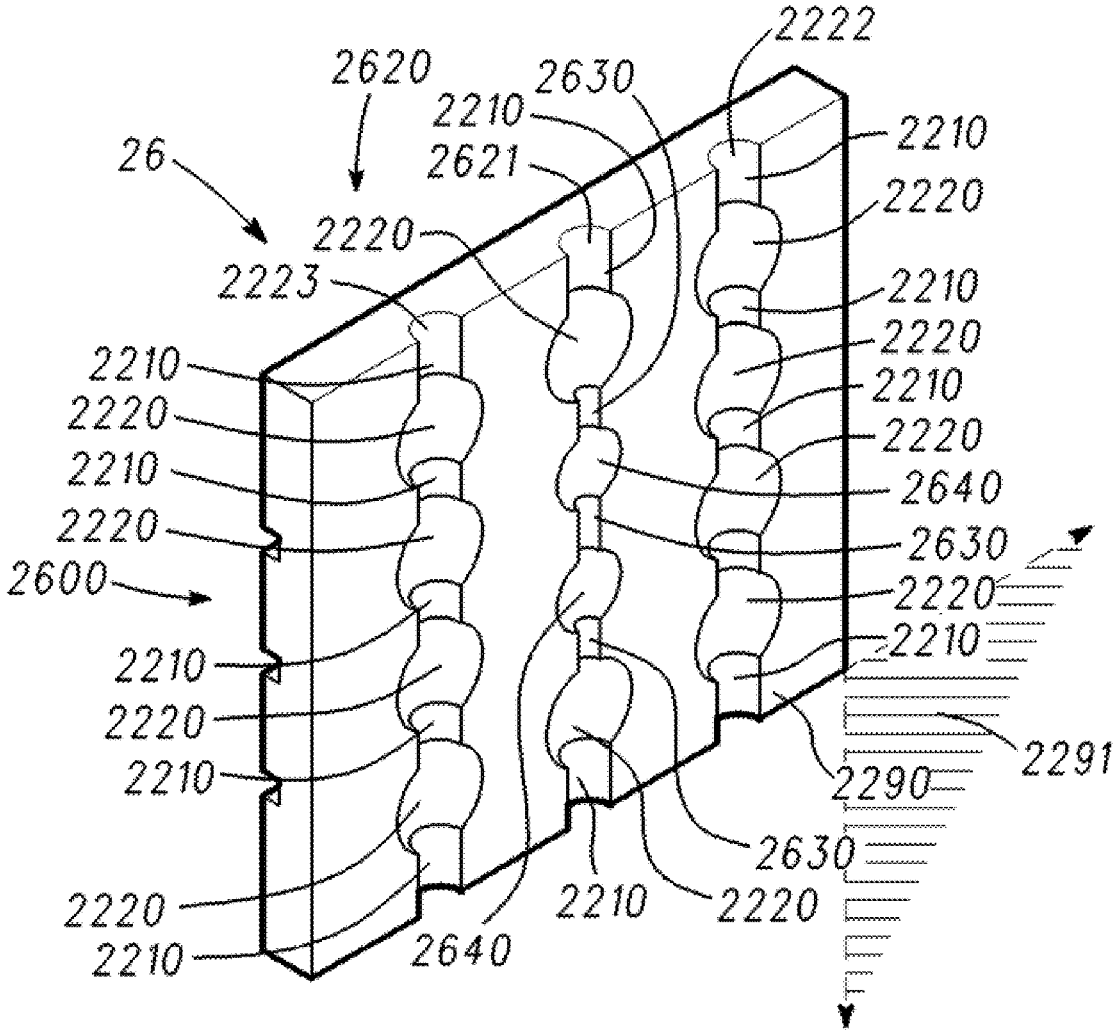
FIG. 26 illustrates a perspective view of part of a strike portion of a club head, where the strike portion comprises a trench-set having at least one trench that comprises two shallow portion sets and two deep portion sets of differing narrowness, in accordance with another embodiment.

Moving on, FIG. 26 illustrates a perspective view of part of strike portion 2600 of club head 26. Strike portion 2600 is similar to strike portion 2500 (FIG. 25), comprising trench-set 2620 similar to trench-set 2520 (FIG. 25). In FIG. 26, trench set 2620 also includes trenches 2222 and 2223, but trench 2521 (FIG. 25) is replaced with trench 2621. In some examples, trench 2621 could be considered to form part of another trench set different than trench-set 2620. Similar to trench 2521, trench 2621 comprises two shallow portion sets 2210 and 2630, and two deep portion sets 2220 and 2640 but trench 2621 differs from trench 2521, as explained below.

In the present embodiment, strike portion 2600 comprises the following characteristics: (1) shallow portion set 2630 is shallower than deep portion set 2640 relative to back face plane 2291; (2) shallow portion set 2630 is narrower than shallow portion set 2210; and (3) deep portion set 2640 is narrower than deep portion set 2220.

In addition, at least in the present embodiment, part of shallow portion set 2630 is positioned closer to a center of strike portion 2600 than part of shallow portion set 2210. Also, part of deep portion set 2640 is positioned closer to the center of strike portion 2600 than part of deep portion set 2220.

As a result, trench 2621 comprises relatively narrower portions closer to the center of strike portion 2600, and relatively larger or broader portions further away from said area. This configuration can serve structural purposes as described above for strike portion 2500. In other embodiments, different aspects of the various trenches in FIGS. 12-26 can be combined together.

Figure 27:
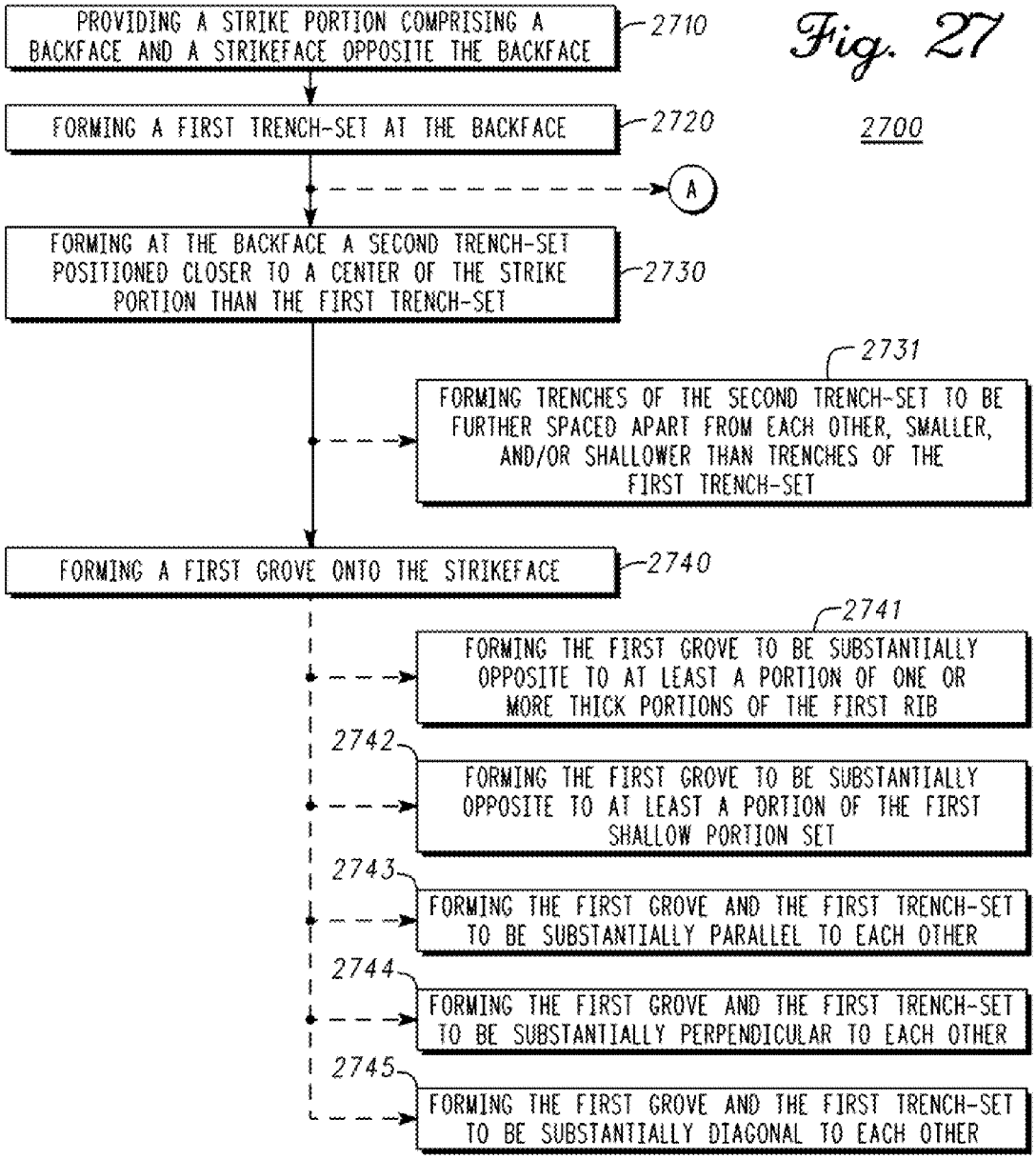
FIG. 27 illustrates a flowchart of a method for manufacturing a club head in accordance with one or more of FIGS. 12-26, according to an embodiment of manufacturing a golf club head.

Moving along, FIG. 27 illustrates a flowchart of a method 2700 for manufacturing a club head. In some embodiments, the club head of method 2700 can be one of club heads 12 (FIGS. 12-14), 15 (FIGS. 15-18), 19 (FIG. 19), 20 (FIG. 20), 21 (FIG. 21), 22 (FIG. 22), 23 (FIG. 23), 24 (FIG. 24), 25 (FIG. 25), and/or 26 (FIG. 26) as described above. In some embodiments, the golf club head of method 2700 can also be a driver-type head, a putter-type head, a wedge-type head, an iron-type head, a hybrid-type head, and/or a fairway wood-type head, among others.

Block 2710 of method 2700 involves providing a strike portion comprising a back face and a strike face opposite the back face. In some embodiments, the strike portion can be strike portion 1200 (FIGS. 12-14), 1500 FIGS. 15-18), 1900 (FIG. 19), 2000 (FIG. 20), 2100 (FIG. 21), 2200 (FIG. 22), 2300 (FIG. 23), 2400 (FIG. 24), 2500 (FIG. 25), and/or 2600 (FIG. 26) as described above, along with their respective strike faces and back faces. For example, the strike face can be strike face 1350 of strike portion 1200, and the back face can be back face 1210 of strike portion 1200 (FIGS. 12-14).

Block 2720 of method 2700 comprises forming a first trench-set at the back face of the strike portion. In some embodiments, the first trench-set can be one of the trench-sets previously described, such as trench-set 1220 (FIGS. 12-14), 2220 (FIG. 22), 2420, and/or 2450 (FIG. 24), among others. In the same or a different embodiment, block 2720 can comprise one or more subparts as described below for FIG. 28, where FIGS. 27 and 28 connect via transition point "A".

Figure 28:
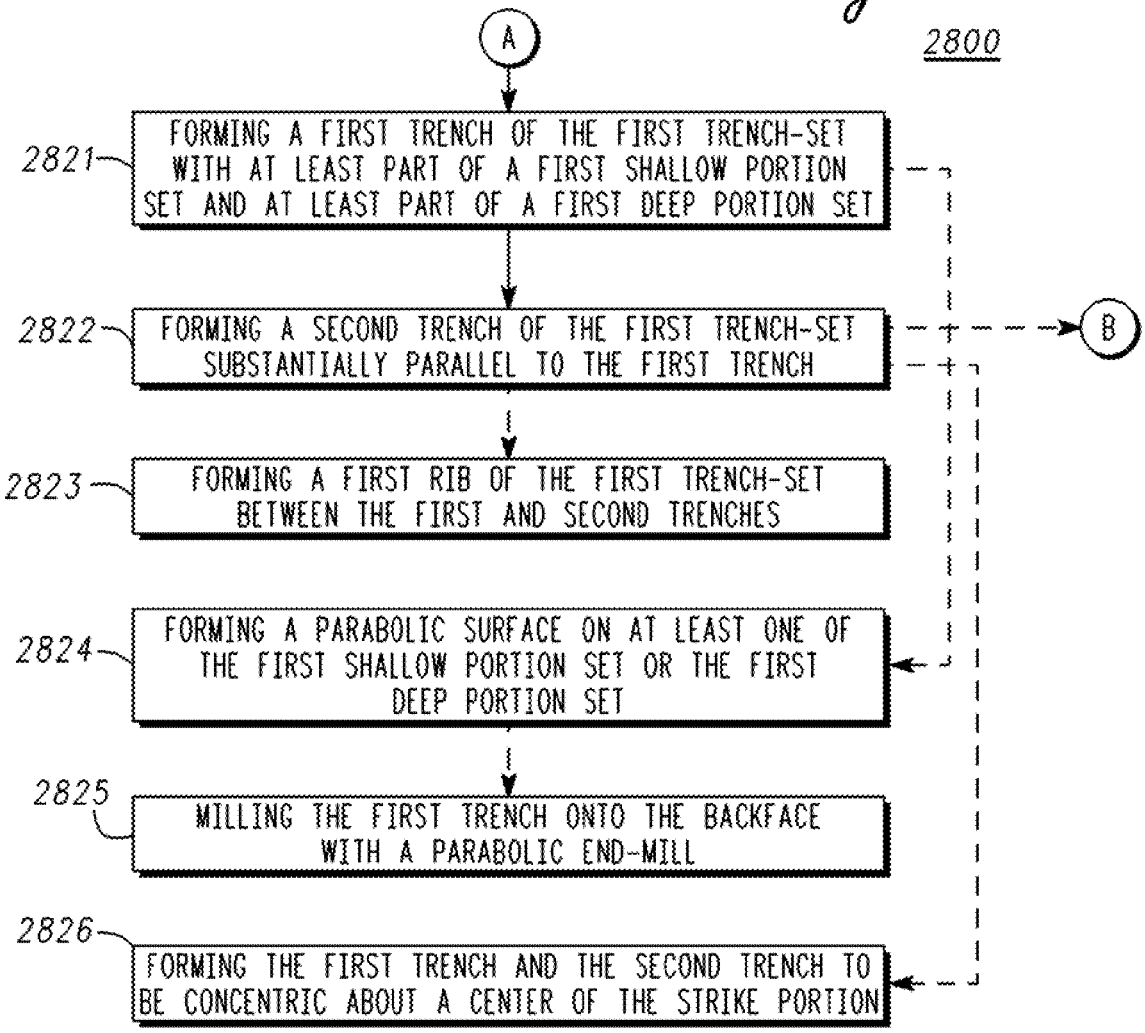
FIG. 28 illustrates a flowchart of a method for forming a trench-set of a strike portion of the club head of the method of FIG. 27.

Skipping ahead, FIG. 28 illustrates a flowchart of a method 2800 for forming the first trench-set of method 2700. Block 2821 of method 2800 comprises forming a first trench of the first trench-set with at least part of a first shallow portion set and at least part of a first deep portion set. Block 2821 can be reached from block 2720 (FIG. 27) through transition point "A" in the present example. In some embodiments, the first trench of block 2821 can be similar to trench 1221 (FIGS. 12-14), while the first shallow and deep portion sets can be similar to shallow portion set 1310 and deep portion set 1320 (FIGS. 12-14), among others previously described.

In some examples, method 2800 can comprise block 2822. Block 2822 comprises forming a second trench of the first trench-set substantially parallel to the first trench, and can be performed simultaneously with, or after, block 2821. As an example, the second trench can be similar to trench 1222 (FIGS. 12-14), among others previously described. In some examples, the first shallow portion set and/or the first deep portion set of block 2821 can be shared between the first trench and the second trench. In other examples, the second trench could comprise its own second shallow portion set and second deep portion set. In different examples, the second trench could comprise its own second shallow portion set and second deep portion set, while still sharing the first shallow and deep portion sets with the first trench. Block 2822 can comprise further subparts, as will be described below with respect to FIG. 29, connected to block 2822 via transition point "B."

Block 2823 of method 2800 comprises forming a first rib of the first trench-set between the first and second trenches. Block 2823 can be performed simultaneously with blocks 2821 and 2822 in some examples. In other examples, block 28223 can be performed in a sequence with blocks 2821-2822. In some examples of block 2823, the first rib can be similar to rib 1231 of strike portion 1200 (FIGS. 12-14), among others previously described. In the same or a different example, block 2823 can be inherently carried out as part of the execution of blocks 2721 and 2722, such that the first rib would be formed as a result of the formation of the first and second trenches.

In some examples, method 2800 involves block 2824, comprising forming a parabolic surface on at least one of the first shallow portion set or the first deep portion set described for block 2821. In some examples, the parabolic surface can be similar to one of the parabolic shapes of shallow portions 1310 and/or deep portions 1320 described above in FIGS. 12-14. Block 2824 can be carried out simultaneously with, or after block 2821. In examples where the first shallow portion set and/or the first deep portion set are shared between the first trench of block 2821 and the second trench of block 2822, block 2824 can be applied to both the first and second trenches, whether simultaneously or in sequence with blocks 2821 and 2822.

In some examples, block 2824 can comprise optional block 2825, comprising milling the first trench onto the back face with a parabolic end-mill. In one example, block 2824 can be carried out by moving the back face of the strike portion relative to the parabolic end-mill, and/or by moving the parabolic end-mill relative to the back face of the strike portion, such that the first deep portion set of the first trench can be milled by extending the parabolic end-mill to a first distance into the back face, and the first shallow portion set of the first trench can be milled after partially retracting the parabolic end-mill to a second distance from the back face. Other manufacturing methods besides or in combination with milling can be used in method 2800 to form the first trench and/or the shallow and deep portions, such as using casting, or hot-forging processes.

Block 2826 of method 2800 is an optional subpart of block 2822, and comprises forming the first trench and the second trench to be concentric about a center of the strike portion. In some examples, the first and second trenches can be concentric as described above for trench-set 2120 in FIG. 21.

Returning to FIG. 27, method 2700 can further comprise block 2730. Block 2730 comprises forming at the back face a second trench-set positioned closer to a center of the strike portion than the first trench-set. In some examples, block 2730 can be optional, such that the club head of method 2700 could have only one trench-set. In the present example, block 2730 also comprises block 2731 as a subpart, where block 2731 is optional, and comprises forming trenches of the second trench-set to be further spaced apart from each other, smaller, and/or shallower than trenches of the first trench-set.

In some examples, the second trench-set can be similar to trench 2321 (FIG. 23), trench 2521 (FIG. 25), and/or trench 2621 (FIG. 26). In other examples blocks 2730 and 2731 can be carried out as previously described for FIG. 24, where the first trench-set can be similar to trench-set 2420, and the second trench-set can be similar to trench-set 2450. Also as shown in FIG. 24, trenches of trench-set 2450 are spaced apart from each other by distance 2451, while trenches of trench-set 2420 are spaced apart from each other by distance 2421, and because distance 2451 is greater than distance 2421, the trenches of trench-set 2450 are further spaced apart from each other than the trenches of trench-set 2420, as required in block 2731.

Continuing with FIG. 27, method 2700 can comprise block 2740. Block 2740 is also optional, and can comprise forming a first groove onto the strike face. As an example, the first groove can be similar to groove 1361 and/or 1362 of groove-set 1360 (FIG. 13), among others previously described. Block 2740 can further comprise other optional subparts, as described below.

Block 2741 of method 2700 can be an optional subpart of block 2740, and can be performed when block 2823 of method 2800 is also carried out. Block 2741 comprises forming the first groove to be substantially opposite to at least a portion of one or more thick portions of the first rib. As an example, as shown in FIG. 13, groove 1361 is shown to be substantially opposite thick portions 13362 and 13361 of ribs 1232 and 1231, respectively. Other examples previously discussed may show similar relationships.

Block 2742 of method 2700 is also an optional subpart of block 2740, and can be performed when block 2821 of method 2800 is also carried out. Block 2742 comprises forming the first groove to be substantially opposite to at least a portion of the first shallow portion set. As an example, as shown in FIG. 13, groove 1361 is shown to be substantially opposite shallow portions 1311 and 1312 of trenches 1221 and 1222, respectively. Other examples previously discussed may show similar relationships.

Block 2743 of method 2700 is a subpart of block 2740, and optionally comprises forming the first groove and the first trench-set to be substantially parallel to each other. For example, grooves 1361 and 1362 are shown to be substantially parallel with trenches 1521-1523 in FIG. 16. Other examples previously discussed may show similar relationships.

Block 2744 of method 2700 is a subpart of block 2740, and optionally comprises forming the first groove and the first trench-set to be substantially perpendicular to each other. For instance, grooves 1361 and 1362 are shown to be substantially perpendicular to trenches 1221-1222 in FIG. 13. Other examples previously discussed may show similar relationships.

Block 2745 of method 2700 is both optional and a subpart of block 2740, and comprises forming the first groove and the first trench-set to be substantially diagonal to each other. For instance, grooves 1361 and 1362 are shown to be substantially diagonal to trench 2021 in FIG. 20. Other examples previously discussed may show similar relationships.

Continuing with the Figures, FIG. 29 illustrates a flowchart of a method 2900 for forming a trench of the trench-set for the strike portion of method 2700. Method 2900 is optional, and in the present example can be reached through transition point "B," performed as part of, or after, block 2822 of method 2800 (FIG. 28).

Method 2900 requires, in block 2910, forming at least one of the first or second trenches to comprise a second shallow portion set and a second deep portion set. As an example, the second shallow portion set can be similar to shallow portion sets 2230 (FIG. 22), 2330 (FIG. 23), 2530 (FIG. 25) and 2630 (FIG. 26), while the second deep portion set can be similar to 2240 (FIG. 22), 2340 (FIG. 24), 2540 (FIG. 25) and 2640 (FIG. 26).

In the present example, block 2910 of method 2900 comprises different optional subparts in blocks 2911-2915. Block 2911 comprises forming the second shallow portion set to be shallower than the second deep portion set relative to a back face plane, where the back face plane can be parallel to a loft plane of the club head even if the back face is not substantially flat.

Block 2912 comprises forming the second shallow portion set to be at least one of shallower or narrower than the first shallow portion set relative to the back face plane. Block 2913 comprises forming the second deep portion set to be at least one of shallower or narrower than the first deep portion set relative to the back face plane. Block 2914 comprises positioning at least part of the second shallow portion set closer to the center of the strike portion than part of the first shallow portion set. Block 2915 comprises positioning at least part of the second deep portion set closer to the center of the strike portion than part of the first deep portion set. In some examples, the subparts of block 2910 of method 2900, namely, blocks 2911-2915, can be as previously illustrated and described for FIGS. 22, 23, 25, and/or 26.

In some examples, one or more of the different blocks of methods 2700, 2800, and/or 2900 can be combined into a single step. For example, blocks 2821-2823 can be combined into a single block, whereby the first rib in block 2823 could be automatically formed when at least one of the first or second trenches of blocks 2821-2822 is formed. In the same or a different example, the sequence of one or more of the different blocks of methods 2700, 2800, and/or 2900 can be changed. As an example, block 2740 can be performed before block 2720 in some examples. In the same or a different example, methods 2700, 2800, and/or 2900 can comprise further or different steps, such as a repetition of block 2730 to form a third trench-set for the strike portion of method 2700.

Although the club heads with contoured back faces and methods of manufacturing the same have been described with reference to specific embodiments, various changes may be made without departing from the spirit or scope of the golf club attachment mechanism and related methods. Various examples of such changes have been given in the foregoing description. As another example, although the different club heads described herein show the back face of their specific strike portions as comprising only the cavity-sets or trench-sets previously described, there may be embodiments where some back faces can further comprise a manufacturer's logo or other embellishments overlayed or otherwise presented therein without interfering with or departing from the concepts described herein. As further examples, one or more cavity sets and one or more trench sets can be combined together in a single club head, or the trench-sets can be modified by the features described for the cavity sets. Moreover, the details of the different embodiments of FIGS. 1-30 can be combined with any of the other embodiments in FIGS. 1-30. Considering the different examples and embodiments described above, the club heads with contoured back faces and methods of manufacturing the same disclosed herein can permit greater adjustment and customization of different design variables used to craft the club heads without unduly compromising the manufacturability and the gaming characteristics of the clubs.

Accordingly, the disclosure of embodiments of the club heads with contoured back faces and methods of manufacturing the same is intended to be illustrative of the scope of the application and is not intended to be limiting. It is intended that the scope of this application shall be limited only to the extent required by the appended claims. For example, it will be readily apparent that the club heads with contoured back faces and methods of manufacturing the same discussed herein may be implemented in a variety of embodiments, and that the foregoing discussion of certain of these embodiments does not necessarily represent a complete description of all possible embodiments. As a specific example, although FIG. 24 shows strike portion 2400 as comprising only two trench-sets 2420 and 2450, other embodiments may comprise more than two trench-sets. Therefore, the detailed description of the drawings, and the drawings themselves, disclose at least one preferred embodiment of the club heads with contoured back faces and methods of manufacturing the same, and may disclose alternative embodiments of the club heads with contoured back faces and methods of manufacturing the same.

All elements claimed in any particular claim are essential to the golf club with variable moment of inertia and methods of manufacture thereof claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A club head, comprising:

a strike portion comprising a back face and a strike face opposite the back face;

wherein:

the back face comprises a first trench set;

the first trench-set comprises a first trench of one or more trenches;

at least the first trench comprises:

a first shallow portion set with one or more first shallow portions; and a first deep portion set with one or more first deep portions;

the first shallow portion set is shallower than the first deep portion set relative to a loft plane of the club head;

the first trench-set further comprises:

a second trench substantially parallel to the first trench; and a first rib set comprising one or more ribs;

the one or more ribs having at least a first rib;

at least the first rib of the first rib set comprises:

one or more narrow portions with a first thickness; and one or more thick portions with a second thickness greater than the first thickness;

the first rib is located between the first and second trenches;

the strike face comprises a first groove and a second groove;

at least two ribs of the first rib set are positioned substantially parallel and opposite to the first and second grooves; and two of the one or more trenches are interleaved with the first and second grooves.

2. A club head, comprising:

a strike portion comprising a back face and a strike face opposite the back face;

wherein:

the back face comprises a first trench set;

the first trench-set comprises a first trench of one or more trenches;

at least the first trench comprises:

a first shallow portion set with one or more first shallow portions; and a first deep portion set with one or more first deep portions;

the first shallow portion set is shallower than the first deep portion set relative to a loft plane of the club head;

the first trench-set further comprises:

a second trench substantially parallel to the first trench; and a first rib set comprising one or more ribs;

the one or more ribs having a first rib;

at least the first rib of the first rib set comprises:

one or more narrow portions with a first thickness; and one or more thick portions with a second thickness greater than the first thickness;

the first rib is located between the first and second trenches;

the strike face comprises a first groove; and at least a first one of the one or more thick portions of at least some of the one or more ribs is positioned substantially opposite to the first groove.

3. The club head of claim 2, wherein:

the first rib comprises a body that is at least one of:

slanted relative to the back face; or substantially parallel to an axis of impact of the club head.

4. The club head of claim 2, wherein:

the strike face comprises a first groove;

the first trench-set is substantially parallel to the first groove.

5. The club head of claim 2, wherein:

the strike face comprises a first groove;

the first trench-set is substantially perpendicular to the first groove.

6. The club head of claim 2, wherein:

the strike face comprises a first groove;

the first trench-set is diagonal relative to the first groove.

7. The club head of claim 2, wherein:

the first trench-set comprises concentric trenches relative to a center of the strike portion.

8. A club head, comprising:

a strike portion comprising a back face and a strike face opposite the back face;

wherein:

the back face comprises a first trench set;

the first trench-set comprises a first trench of one or more trenches;

at least the first trench comprises:

a first shallow portion set with one or more first shallow portions; and a first deep portion set with one or more first deep portions;

the first shallow portion set is shallower than the first deep portion set relative to a loft plane of the club head; and at least a first one of the one or more first shallow or deep portions comprises a parabolic shape.

9. A club head, comprising:

a strike portion comprising a back face and a strike face opposite the back face;

wherein:

the back face comprises a first trench set;

the first trench-set comprises a first trench of one or more trenches;

at least the first trench comprises:

a first shallow portion set with one or more shallow portions; and a first deep portion set with one or more first deep portions;

the first shallow portion set is shallower than the first deep portion set relative to a loft plane of the club head;

the strike face comprises a first groove; and at least a first one of the one or more shallow portions of some of the one or more trenches of the first trench-set are positioned substantially opposite to the first groove.

10. The club head of claim 9, wherein:

the one or more first shallow portions alternate with the one or more first deep portions along a length of the first trench.

11. A club head, comprising:

a strike portion comprising a back face and a strike face opposite the back face;

wherein:

the back face comprises a first trench set;

the first trench-set comprises a first trench of one or more trenches;

at least the first trench comprises:

a first shallow portion set with one or more first shallow portions; and a first deep portion set with one or more first deep portions;

the first shallow portion set is shallower than the first deep portion set relative to a loft plane of the club head;

the first trench-set further comprises a second trench;

the second trench comprises:

a second shallow portion set; and a second deep portion set;

the second shallow portion set is shallower than the second deep portion set relative to a plane of the back face;

the second shallow portion set is shallower than the first shallow portion set relative to the plane;

the second deep portion set is shallower than the first deep portion set relative to the plane;

at least a part of the second shallow portion set is positioned closer to a center of the strike portion than a part of the first shallow portion set; and at least a part of the second deep portion set is positioned closer to the center of the strike portion than a part of the first deep portion set.

12. A club head, comprising:

a strike portion comprising a back face and a strike face opposite the back face;

wherein:

the back face comprises a first trench set;

the first trench-set comprises a first trench of one or more trenches;

at least the first trench comprises:

a first shallow portion set with one or more first shallow portions; and a first deep portion set with one or more first deep portions;

the first shallow portion set is shallower than the first deep portion set relative to a loft plane of the club head;

the first trench-set further comprises a second trench;

the second trench comprises:

a second shallow portion set; and a second deep portion set;

the second shallow portion set is shallower than the second deep portion set relative to a plane of the back face;

the second shallow portion set is narrower than the first shallow portion set;

the second deep portion set is narrower than the first deep portion set;

at least a part of the second shallow portion set is positioned closer to a center of the strike portion than a part of the first shallow portion set; and at least a part of the second deep portion set is positioned closer to the center of the strike portion than a part of the first deep portion set.

13. A club head, comprising:

a strike portion comprising a back face and a strike face opposite the back face;

wherein:

the back face comprises a first trench set;

the first trench-set comprises a first trench of one or more trenches;

at least the first trench of the one or more trenches comprises:

a first shallow portion set with one or more first shallow portions; and a first deep portion set with one or more first deep portions;

the first shallow portion set is shallower than the first deep portion set relative to a loft plane of the club head;

the back face further comprises a second trench-set of one or more trenches;

the one or more trenches of the first trench-set are spaced apart from each other by a first distance;

the one or more trenches of the second trench-set are spaced apart from each other by a second distance;

the second distance is greater than the first distance; and the second trench-set is positioned closer to a center of the strike portion than the first trench-set.

14. A club head, comprising:

a strike portion comprising a back face and a strike face opposite the back face;

wherein:

the back face comprises a first trench set;

the first trench-set comprises a first trench of one or more trenches;

the first trench comprises:

a first shallow portion set with one or more first shallow portions; and a first deep portion set with one or more first deep portions;

the first shallow portion set is shallower than the first deep portion set relative to a loft plane of the club head;

the first trench further comprises:

a second shallow portion set; and a second deep portion set;

the second shallow portion set is shallower than the second deep portion set relative to a plane of the back face;

the second shallow portion set is shallower than the first shallow portion set relative to the plane;

the second deep portion set is shallower than the first deep portion set relative to the plane;

at least a part of the second shallow portion set is positioned closer to a center of the strike portion than a part of the first shallow portion set; and at least a part of the second deep portion set is positioned closer to the center of the strike portion than a part of the first deep portion set.

15. A club head, comprising:

a strike portion comprising a back face and a strike face opposite the back face;

wherein:

the back face comprises a first trench set;

the first trench-set comprises a first trench of one or more trenches;

the first trench comprises:

a first shallow portion set with one or more first shallow portions; and a first deep portion set with one or more first deep portions;

the first shallow portion set is shallower than the first deep portion set relative to a loft plane of the club head; and the first trench further comprises:

a second shallow portion set; and a second deep portion set;

the second shallow portion set is shallower than the second deep portion set relative to a plane of the back face;

the second shallow portion set is narrower than the first shallow portion set;

the second deep portion set is narrower than the first deep portion set;

at least a part of the second shallow portion set is positioned closer to a center of the strike portion than a part of the first shallow portion set; and at least a part of the second deep portion set is positioned closer to the center of the strike portion than a part of the first deep portion set.

16. A method for manufacturing a club head, the method comprising:

providing a strike portion comprising a back face and a strike face opposite the back face;

forming in the back face a first trench-set comprising a first trench;

forming a second trench of the first trench-set substantially parallel to the first trench, and a first rib of the first trench-set between the first and second trenches; and forming a first groove into the strike face;

wherein:

the first trench comprises:

a first shallow portion set; and a first deep portion set;

the first shallow portion set is shallower than the first deep portion set relative to a surface of the back face; and shallow portions of the first shallow portion set alternate with deep portions of the first deep portion set along a length of the first trench;

the first rib comprises:

one or more narrow portions with a first thickness;

one or more thick portions with a second thickness greater than the first thickness; and a body that is at least one of:

substantially perpendicular to the back face;

complementary to a loft angle of the strike face; or substantially parallel to an axis of impact of the club head;

at least a portion of the one or more thick portions is substantially opposite the first groove.

17. A method for manufacturing a club head, the method comprising:

providing a strike portion comprising a back face and a strike face opposite the back face; and forming in the back face a first trench-set comprising a first trench;

wherein:

the first trench comprises:

a first shallow portion set; and a first deep portion set;

the first shallow portion set is shallower than the first deep portion set relative to a surface of the back face;

shallow portions of the first shallow portion set alternate with deep portions of the first deep portion set along a length of the first trench; and forming in the back face the first trench-set further comprises:

forming a parabolic surface on at least one of the first shallow portion set or the first deep portion set of the first trench.

18. A method for manufacturing a club head, the method comprising:

providing a strike portion comprising a back face and a strike face opposite the back face;

forming in the back face a first trench-set comprising a first trench; and forming a first groove into the strike face;

wherein:

the first trench comprises:

a first shallow portion set; and a first deep portion set;

the first shallow portion set is shallower than the first deep portion set relative to a surface of the back face;

shallow portions of the first shallow portion set alternate with deep portions of the first deep portion set along a length of the first trench; and forming in the back face the first trench-set further comprises:

forming at least a portion of the first shallow portion set of the first trench substantially opposite the first groove.

19. A method for manufacturing a club head, the method comprising:

providing a strike portion comprising a back face and a strike face opposite the back face; and forming in the back face a first trench-set comprising a first trench;

wherein:

the first trench comprises:

a first shallow portion set; and a first deep portion set;

the first shallow portion set is shallower than the first deep portion set relative to a surface of the back face;

shallow portions of the first shallow portion set alternate with deep portions of the first deep portion set along a length of the first trench;

forming in the back face the first trench-set further comprises forming a second trench of the first trench-set;

at least one of the first or second trenches comprises:

a second shallow portion set; or a second deep portion set;

the second shallow portion set is shallower than the second deep portion set relative to a back face plane;

the second shallow portion set is at least one of shallower or narrower than the first shallow portion set;

the second deep portion set is at least one of shallower or narrower than the first deep portion set;

at least a part of the second shallow portion set is positioned closer to a center of the strike portion than a part of the first shallow portion set; and at least a part of the second deep portion set is positioned closer to the center of the strike portion than a part of the first deep portion set.

20. A method for manufacturing a club head, the method comprising:

providing a strike portion comprising a back face and a strike face opposite the back face;

forming in the back face a first trench-set comprising a first trench; and forming on the back face a second trench-set positioned closer to a center of the strike portion than the first trench-set;

wherein:

the first trench comprises:

a first shallow portion set; and a first deep portion set;

the first shallow portion set is shallower than the first deep portion set relative to a surface of the back face;

shallow portions of the first shallow portion set alternate with deep portions of the first deep portion set along a length of the first trench; and trenches of the second trench-set are further spaced apart from each other than trenches of the first trench-set.

21. A method for manufacturing a club head, the method comprising:

providing a strike portion comprising a back face and a strike face opposite the back face;

forming in the back face a first trench-set comprising a first trench; and forming a first groove onto the strike face;

wherein:

the first trench comprises:

a first shallow portion set; and a first deep portion set;

the first shallow portion set is shallower than the first deep portion set relative to a surface of the back face;

shallow portions of the first shallow portion set alternate with deep portions of the first deep portion set along a length of the first trench; and forming the first trench-set further comprises at least one of:

forming trenches substantially parallel to the first groove;

forming trenches substantially perpendicular to the first groove;

forming trenches substantially diagonal to the first groove; or forming concentric trenches relative to a center of the strike portion.

22. A method for manufacturing a club head, the method comprising:

providing a strike portion comprising a back face and a strike face opposite the back face; and forming in the back face a first trench-set comprising a first trench;

wherein:

the first trench comprises:

a first shallow portion set; and a first deep portion set;

the first shallow portion set is shallower than the first deep portion set relative to a surface of the back face;

shallow portions of the first shallow portion set alternate with deep portions of the first deep portion set along a length of the first trench; and forming the first trench-set comprises:

milling the first trench onto the back face with a parabolic end-mill.

23. A method for manufacturing a club head, the method comprising:

providing a strike portion comprising a back face and a strike face opposite the back face; and forming in the back face a first trench-set comprising a first trench;

wherein:

the first trench comprises:

a first shallow portion set; and a first deep portion set;

the first shallow portion set is shallower than the first deep portion set relative to a surface of the back face;

shallow portions of the first shallow portion set alternate with deep portions of the first deep portion set along a length of the first trench; and forming on the back face the first trench-set occurs simultaneously with providing the strike portion.

24. A club comprising:

a club shaft;

a club head coupled to the shaft; and a strike portion coupled to the club head, the strike portion comprising:

a strike face with a first groove;

a back face opposite the strike face; and a first trench-set at the back face;

wherein:

the first trench-set comprises:

a first trench of one or more trenches;

a second trench of the one or more trenches; and a first rib between the first and second trenches;

at least the first trench of the one or more trenches comprises:

a first shallow portion set with one or more first shallow portions; and a first deep portion set with one or more first deep portions;

the first shallow portion set is shallower than the first deep portion set relative to a plane of the back face;

the one or more first shallow portions alternate with the one or more first deep portions along a length of the first trench;

the first rib comprises:

one or more narrow portions with a first thickness;

one or more thick portions with a second thickness greater than the first thickness; and a rib body that is at least one of:

substantially perpendicular to the back face;

slanted relative to a loft plane of the club head; or substantially parallel to an axis of impact of the club head;

the first trench-set is at least one of:

substantially parallel to the first groove;

substantially perpendicular to the first groove;

diagonal relative to the first groove; or concentric relative to a center of the strike portion;

at least one of the first trench or the second trench comprises:

a second shallow portion set; or a second deep portion set;

the second shallow portion set is shallower than the second deep portion set relative to the plane of the back face;

the second shallow portion set is at least one of shallower or narrower than the first shallow portion set;

the second deep portion set is at least one of shallower or narrower than the first deep portion set;

at least a part of the second shallow portion set is positioned closer to a center of the strike portion than a part of the first shallow portion set; and at least a part of the second deep portion set is positioned closer to the center of the strike portion than a part of the first deep portion set.

25. The club of claim 24, further comprising:

a second trench-set at the back face;

wherein:

the second trench-set is positioned closer to a center of the strike portion than the first trench-set;

trenches of the second trench-set are further spaced apart from each other than trenches of the first trench-set; and at least one of the first or second trench-sets comprises a portion with a parabolic inner surface.

* * * * *